US009529291B2

(12) United States Patent
Ota et al.

(10) Patent No.: US 9,529,291 B2
(45) **Date of Patent: *Dec. 27, 2016**

(54) IMAGE FORMING APPARATUS AND IMAGE FORMING METHOD

(71) Applicant: FUJI XEROX CO., LTD., Tokyo (JP)

(72) Inventors: Naoki Ota, Kanagawa (JP); Katsuyuki Kitajima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/922,779

(22) Filed: Oct. 26, 2015

(65) Prior Publication Data

US 2016/0349639 A1 Dec. 1, 2016

(30) Foreign Application Priority Data

May 28, 2015 (JP) ..... 2015-109028

(51) Int. Cl.
*G03G 9/08* (2006.01)
*G03G 15/02* (2006.01)

(52) U.S. Cl.
CPC ..... *G03G 9/0819* (2013.01); *G03G 15/02* (2013.01)

(58) Field of Classification Search
CPC ... G03G 9/0804; G03G 9/087; G03G 9/08797
See application file for complete search history.

(56) References Cited

U.S. PATENT DOCUMENTS

2009/0041500 A1* 2/2009 Mitsumori ..... G03G 9/0819 399/159

FOREIGN PATENT DOCUMENTS

JP 2002-072807 A 3/2002
JP 2010-134124 A 6/2010

* cited by examiner

*Primary Examiner* — Erika J Villaluna
(74) *Attorney, Agent, or Firm* — Sughrue Mion, PLLC

(57) ABSTRACT

An image forming apparatus includes an electrophotographic photoreceptor, a charging unit; an electrostatic latent image forming unit, a developing unit that stores a developer containing a toner, a transfer unit, a cleaning unit and a fixation unit, wherein the toner has a sea and island structure of a sea portion containing the binder resin and an island portion containing the release agent, a maximum frequent value of the eccentricity B of the island portion containing the release agent is in a range of from 0.75 to 0.95, and a skewness of the eccentricity B is in a range of from −1.10 to −0.50.

10 Claims, 4 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2015-109028 filed May 28, 2015.

BACKGROUND

1. Technical Field

The present invention relates to an image forming apparatus and an image forming method.

2. Related Art

Formation of an image by using an electrophotographic technology is performed as follows. The entirety of a surface of a photoreceptor is charged, and then the surface of the photoreceptor is exposed by using laser beams in accordance with image information so as to form an electrostatic latent image on the surface of the photoreceptor. Then, the formed electrostatic latent image is developed by using a developer containing a toner, and thus a toner image is formed. At last, the formed toner image is transferred onto a surface of a recording medium and then fixing is performed.

SUMMARY

According to an aspect of the invention, there is provided an image forming apparatus including:

an electrophotographic photoreceptor that includes a charge generation layer, a charge transport layer, and an overcoat layer on an electroconductive substrate;

a charging unit that charges a surface of the electrophotographic photoreceptor;

an electrostatic latent image forming unit that forms an electrostatic latent image on the charged surface of the electrophotographic photoreceptor;

a developing unit that stores a developer containing a toner and develops the electrostatic latent image formed on the surface of the electrophotographic photoreceptor by using the developer so as to form a toner image;

a transfer unit that transfers the toner image onto a surface of a recording medium;

a cleaning unit that includes a cleaning blade which contacts with the electrophotographic photoreceptor and removes residual substances on the surface of the electrophotographic photoreceptor; and a fixation unit that fixes the toner image transferred to the recording medium, wherein the toner contains a binder resin, a colorant, and a release agent and has a sea and island structure of a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from a centroid of the toner to a centroid of the island portion containing the release agent in the observation of a cross-section of the toner.

BRIEF DESCRIPTION OF THE DRAWINGS

Exemplary embodiments of the present invention will be described in detail based on the following figures, wherein.

DETAILED DESCRIPTION

Figure 1:
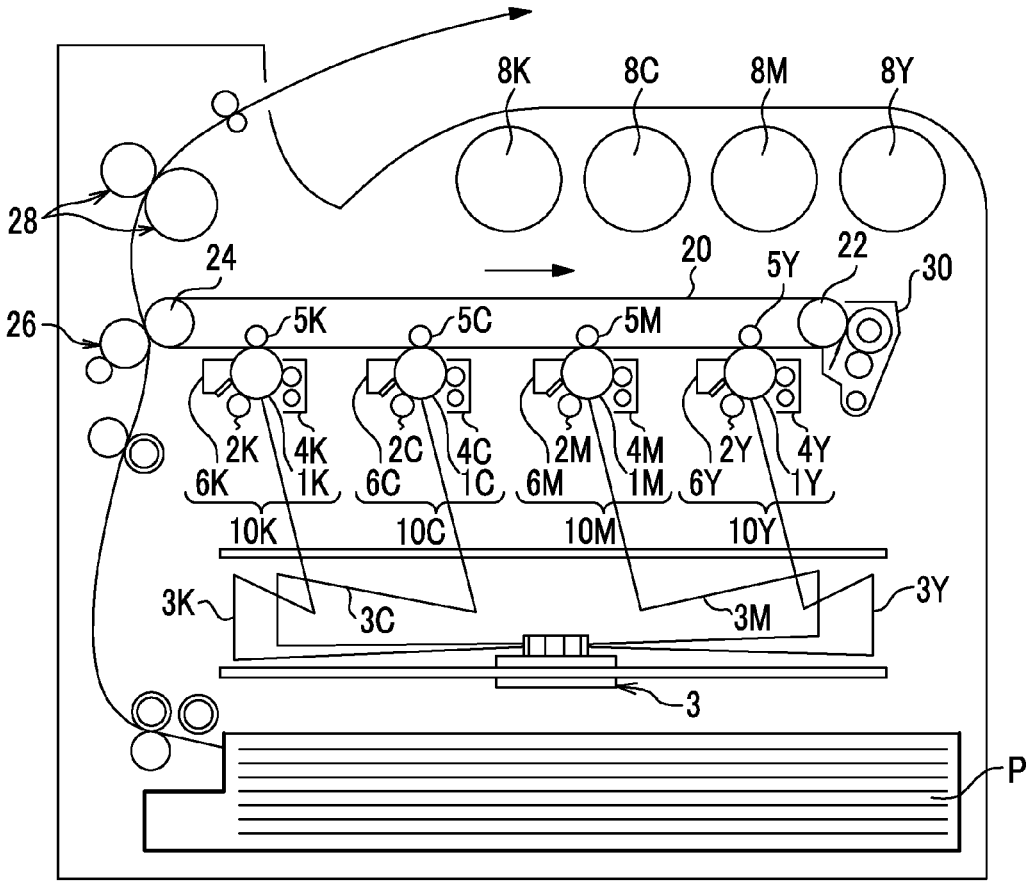
FIG. 1 is a schematic configuration diagram illustrating an example of an image forming apparatus according to this exemplary embodiment.

Hereinafter, an exemplary embodiment which is an example of the invention will be described in detail.

Image Forming Apparatus/Image Forming Method

An image forming apparatus according to this exemplary embodiment includes an electrophotographic photoreceptor, a charging unit, an electrostatic latent image forming unit, a developing unit, a transfer unit, a cleaning unit, and a fixation unit. The electrophotographic photoreceptor (which may be referred to as a "specific photoreceptor" below) includes a charge generation layer, a charge transport layer, and an overcoat layer on an electroconductive substrate in this order. The charging unit charges a surface of the specific photoreceptor. The electrostatic latent image forming unit forms an electrostatic latent image on the charged surface of the specific photoreceptor. The developing unit stores a developer including a specific toner (which will be described later), and develops the electrostatic latent image formed on the surface of the specific photoreceptor by using the developer so as to form a toner image. The transfer unit transfers the toner image onto a surface of a recording medium. The cleaning unit includes a cleaning blade which contacts with the electrophotographic photoreceptor and removes residual substances on the surface of the electrophotographic photoreceptor, and preferable is a cleaning unit (which may be referred to as a "specific cleaning unit" below) which includes a cleaning blade provided such that a tip end of the cleaning blade contacts with the specific photoreceptor and is directed to a direction facing a rotation direction of the specific photoreceptor, to thereby remove residual substances on the surface of the specific photoreceptor. The fixation unit fixes the toner image transferred to the recording medium.

An electrophotographic photoreceptor which includes an overcoat layer on a charge generation layer and a charge transport layer (corresponding to the specific photoreceptor in this exemplary embodiment) has been used because the electrophotographic photoreceptor has a long lifetime and is capable of continuously forming a lot of images, for example.

An image forming apparatus including such an electrophotographic photoreceptor is used for a long period of time. If a toner is exposed to heat in the developing unit for a long period of time, in use of the image forming apparatus, and then a lot of images (for example, 10,000 recording media of the A4 size) are continuously formed by using a developer including the toner exposed to heat, the toner may adhere to a surface of the electrophotographic photoreceptor, that is, photoreceptor filming may occur. Particularly, in an image forming apparatus including a cleaning unit (corresponding to the specific cleaning unit in this exemplary embodiment) which has a cleaning blade of which a tip end is directed to a direction facing a rotation direction of the electrophotographic photoreceptor while contacting with the electrophotographic photoreceptor, and removes residual substances on the surface of the electrophotographic photoreceptor by using the cleaning blade, for example, detachability of an external additive from the toner is deteriorated by the heat; and frictional force between the photoreceptor and the blade, which has been prevented by the external additive in the vicinity of an edge of the blade, is increased. Thus, photoreceptor filming easily occurs.

For example, a method of increasing a content of a release agent in the toner is used for preventing the photoreceptor filming. The release agent is evaporated (volatilized) by the heat and then is cooled in the image forming apparatus. Thus, the release agent is solidified and coarse particulates referred to as ultrafine particles (UFP, particles having a diameter of 0.1 μm or less) may be formed. If the content of the release agent in the toner is simply increased, the amount of the exposed release agent on a surface of the toner is increased, for example. Thus, these coarse particulates (UFP) may be formed more.

Accordingly, a method of preventing the photoreceptor filming without an increase of the content of the release agent in the toner for the toner in which the release agent is included only in the inside (specifically, the toner having the maximum frequent value of less than 0.75 in distribution of eccentricity B at an island portion containing the release agent) is currently desired.

The image forming apparatus according to this exemplary embodiment is an image forming apparatus including the specific photoreceptor which includes the overcoat layer, the specific cleaning unit which includes the cleaning blade, and the developer which contains the specific toner which will be described later.

The specific toner contains a binder resin, a colorant, and a release agent, and has a sea and island structure of a sea portion containing the binder resin and an island portion containing the release agent. A maximum frequent value in distribution of the following eccentricity B of the island portion containing the release agent is in a range of from 0.75 to 0.95, a skewness in the distribution of the following eccentricity B is in a range of from −1.10 to −0.50, and the eccentricity B is represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from the centroid of the toner to the centroid of the island portion containing the release agent in the observation of a cross-section of the toner.

The eccentricity B of the island portion containing the release agent (also referred to as a "release agent domain" below) in the specific toner is an index indicating a distance of the centroid of the release agent domain from the centroid of the toner. A larger value of the eccentricity B indicates that the release agent domain exists closer to the surface of the toner. A smaller value of the eccentricity B indicates that the release agent domain exists closer to the center of the toner. The maximum frequent value in the distribution of the eccentricity B indicates a portion at which the release agent domain exists in the largest amount in a radial direction of the toner. The skewness of the distribution of the eccentricity B indicates bilateral symmetry of the distribution. Specifically, the skewness of the distribution of the eccentricity B indicates a degree of unevenness from the maximum frequent value in the distribution. That is, the skewness of the distribution of the eccentricity B indicates a degree of the distribution of the release agent domain from the portion where the release agent domain exists in the largest amount in the radial direction of the toner.

Figure 5:
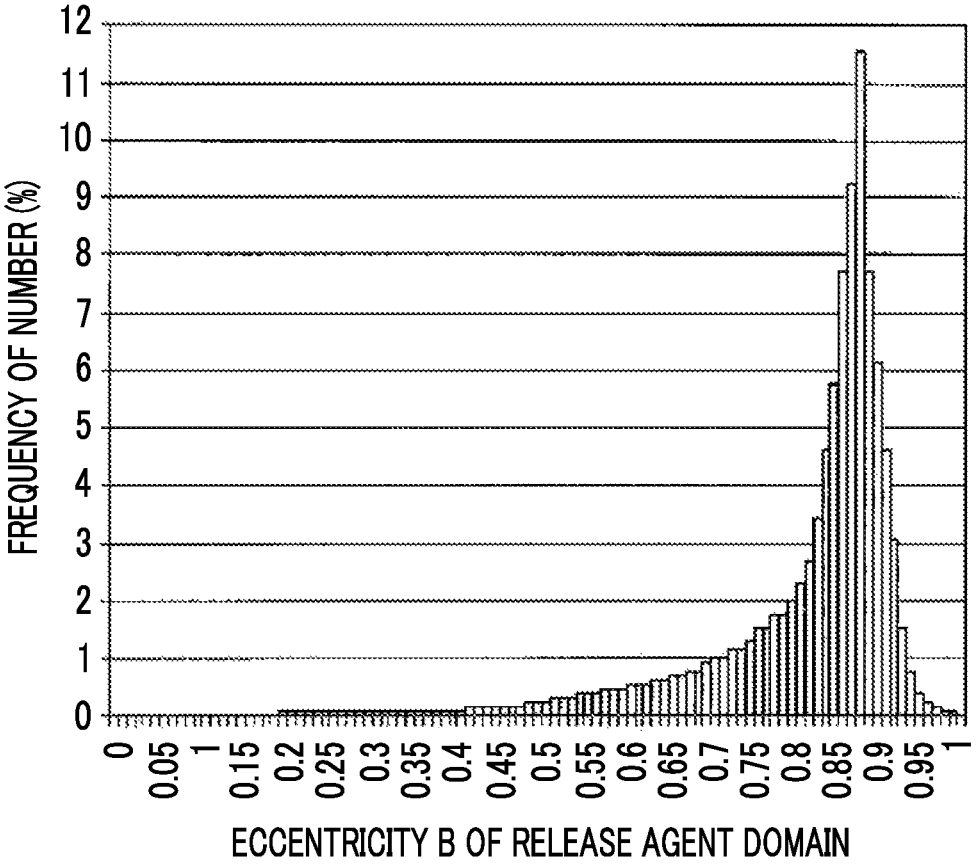
FIG. 5 is a diagram illustrating an example of a distribution of eccentricity B of a release agent domain in a toner, according to this exemplary embodiment.

That is, the maximum frequent value in the distribution of the eccentricity B of the release agent domain being in a range of from 0.75 to 0.95 means that the release agent domain exists in the largest amount at a position close to a surface layer portion of the toner. The skewness of the distribution of the eccentricity B of the release agent domain being in a range of from −1.10 to −0.50 means that the release agent domain is distributed inwardly from the surface layer portion of the toner with a gradient (see FIG. 5).

In this manner, the specific toner in which the maximum frequent value and the skewness of the distribution of the eccentricity B of the release agent domain respectively satisfy the above-described ranges is a toner in which the release agent domain exists in the largest amount in the vicinity of the surface layer portion and is distributed to the vicinity of the surface layer portion from the inside of the toner with a gradient. The toner having such a gradient for the distribution of the release agent domain has properties that the release agent which is close to the surface layer portion of the toner easily bleeds at low pressure, and if it receives high pressure, the release agent in the inside of the toner as well as the release agent close to the surface layer portion of the toner bleeds. That is, regarding the toner having a concentration gradient of the release agent domain, the amount of bleeding of the release agent is controlled in accordance with pressure.

If low pressure is applied to the specific toner having the properties by the specific cleaning unit and the like, a portion of the release agent close to the surface layer portion of the toner bleeds and thus the release properties appear and occurrence of photoreceptor filming is prevented. Since the release agent is also contained in the inside of the specific toner in addition to the vicinity of the surface layer portion, excessive bleeding of the release agent when low pressure is applied is prevented.

When fixing is performed, high pressure is applied to the specific toner. Thus, the release agent in the inside of the toner bleeds besides the release agent close to the surface layer portion of the toner. Accordingly, the release properties are shown sufficiently.

Here, from a viewpoint of prevention of the photoreceptor filming, a toner in which the release agent exists only at the surface layer portion may be provided. However, in this toner, it is considered that the amount of exposure of the release agent on a surface of the toner is increased and the number of the coarse particulates is increased. In a case of the toner in which the release agent exists only at the surface layer portion, meltability of the toner may be deteriorated and fixation defect may be caused when fixing is performed.

As described above, the image forming apparatus according to this exemplary embodiment includes the specific toner having the concentration gradient in the release agent domain and thus it is possible to ensure release properties in fixing and to prevent the photoreceptor filming.

Particularly, the specific toner having the concentration gradient in the release agent domain causes no need for increasing the content of the release agent for the toner containing the release agent only in the inside of the toner (specifically, toner in which the maximum frequent value in the distribution of the eccentricity B at the island portion containing the release agent is less than 0.75). Thus, increasing of the coarse particulates formed due to the release agent is also difficult.

In the image forming apparatus according to this exemplary embodiment, an image forming method (image forming method according to this exemplary embodiment) is performed. The image forming method includes a charging process, an electrostatic latent image forming process, a developing process, a transfer process, a cleaning process, and a fixing process. In the charging process, the surface of the specific photoreceptor is charged. In the electrostatic latent image forming process, an electrostatic latent image is formed on the charged surface of the specific photoreceptor. In the developing process, the electrostatic latent image formed on the surface of the specific photoreceptor is developed by using the developer containing the specific toner (which will be described later) and thereby a toner image is formed. In the transfer process, the toner image is transferred onto the surface of the recording medium. In the cleaning process, residual substances on the surface of the specific photoreceptor is removed by a cleaning blade provided such that a tip end of the cleaning blade contacts with the specific photoreceptor and is directed to a direction facing the rotation direction of the specific photoreceptor. In the fixing process, the toner image transferred to the recording medium is fixed.

Configuration of Image Forming Apparatus

The configuration of the well-known image forming apparatus is applied to the image forming apparatus according to this exemplary embodiment. Examples of the well-known image forming apparatus include a direct transfer type apparatus that directly transfers a toner image formed on a surface of an electrophotographic photoreceptor to a recording medium; an intermediate transfer type apparatus that primarily transfers a toner image formed on a surface of an electrophotographic photoreceptor to a surface of an intermediate transfer member, and secondarily transfers the toner image which has been transferred onto the surface of the intermediate transfer member to a surface of a recording medium; an apparatus including an erasing unit that performs erasing by irradiating a surface of an electrophotographic photoreceptor with eraser light after transferring of a toner image and before charging; an apparatus including an electrophotographic photoreceptor heating member for increasing the temperature of an electrophotographic photoreceptor so as to reduce the relative temperature.

In a case of the intermediate transfer type apparatus, for example, a configuration is applied in which a transfer unit includes an intermediate transfer member onto the surface of which the toner image is transferred, a primary transfer unit that primarily transfers the toner image formed on the surface of the electrophotographic photoreceptor onto a surface of the intermediate transfer member, and a secondary transfer unit that secondarily transfers the toner image which has been transferred onto the surface of the intermediate transfer member onto the surface of the recording medium.

In the image forming apparatus according to this exemplary embodiment, for example, a part at which the electrophotographic photoreceptor is included may be a cartridge structure (process cartridge) which is detachable from the image forming apparatus. As the process cartridge, for example, a process cartridge which includes a specific photoreceptor having the above-described layer structure and the above-described specific cleaning unit is appropriately used. This process cartridge may include, for example, at least one unit selected from the group of the charging unit, the electrostatic latent image forming unit, the developing unit, and the transfer unit, in addition to the electrophotographic photoreceptor and the cleaning unit.

An example of the image forming apparatus according to this exemplary embodiment will be described below. However, it is not limited thereto. Main components illustrated in the drawings will be described and descriptions of other components will be omitted.

FIG. 1 is a schematic configuration diagram illustrating the image forming apparatus according to this exemplary embodiment.

The image forming apparatus illustrated in FIG. 1 includes first to fourth electrophotographic image forming units 10Y, 10M, 10C, and 10K (image forming units) that respectively print yellow (Y), magenta (M), cyan (C), and black (K) images based on color-separated image data. These image forming units (which may be simply referred to as "units" below) 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing so as to extend through the units. The intermediate transfer belt 20 is wound on a driving roller 22 and a support roller 24 contacting the inner surface of the intermediate transfer belt 20, which are separated from each other on the left and right sides in the drawing, and the intermediate transfer belt 20 travels in a direction toward the fourth unit 10K from the first unit 10Y. A force is applied to the support roller 24 in a direction in which it departs from the driving roller 22 by a spring or the like (not illustrated), and a tension is applied to the intermediate transfer belt 20 wound on both of the rollers. In addition, an intermediate transfer member cleaning device 30 is provided on a surface of the intermediate transfer belt 20 on the photoreceptor side so as to face the driving roller 22.

The developers including toners of four colors are respectively stored in developing devices (one example of developing units) 4Y, 4M, 4C, and 4K of the units 10Y, 10M, 10C, and 10K. Further, a yellow toner, a magenta toner, a cyan toner, and a black toner contained in toner cartridges 8Y, 8M, 8C, and 8K are respectively supplied to the developing devices 4Y, 4M, 4C, and 4K.

The first to fourth units 10Y, 10M, 10C, and 10K have the same configuration. Thus, only the first unit 10Y that is disposed on the upstream side in a traveling direction of the intermediate transfer belt and forms a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y includes a photoreceptor 1Y.

Here, a rotation speed of the photoreceptor 1Y (that is, a speed of moving of a surface of the photoreceptor 1Y) is set in accordance with the type of an image to be formed or the type of a recording medium, and the like. However, from a viewpoint that image formation at a high speed is required, the rotation speed of the photoreceptor 1Y is preferably equal to or higher than 300 mm/s, is more preferably equal to or higher than 500 mm/s, and is further preferably in a range of from 500 mm/s to 750 mm/s.

Around the photoreceptor 1Y, a charging roller (an example of the charging unit) 2Y, an exposure device (an example of the electrostatic charge image forming unit) 3, a developing device (an example of the developing unit) 4Y, a primary transfer roller (an example of the transfer unit) 5Y, and a photoreceptor cleaning device (an example of the cleaning unit) 6Y are arranged along a rotation direction in sequence. The charging roller 2Y charges a surface of the photoreceptor 1Y to a predetermined potential. The exposure device 3 exposes the charged surface with laser beams 3Y based on a color-separated image signal to form an electrostatic charge image. The developing device 4Y supplies a charged toner to the electrostatic charge image to develop the electrostatic charge image. The primary transfer roller 5Y transfers the developed toner image onto the intermediate transfer belt 20. The photoreceptor cleaning device 6Y removes the residual substances remaining on the surface of the photoreceptor 1Y after primary transfer.

The primary transfer roller 5Y is disposed inside the intermediate transfer belt 20 to be provided at a position facing the photoreceptor 1Y. Bias supplies (not illustrated) that apply a primary transfer bias are respectively connected to the primary transfer rollers 5Y, 5M, 5C, and 5K. Each of the bias supplies changes a transfer bias that is applied to each of the primary transfer rollers under the control of a controller (not illustrated).

In this exemplary embodiment, at least one unit (preferably, all of the units) of the first to fourth units 10Y, 10M, 10C, and 10K is a unit that includes the specific photoreceptor as the photoreceptor and the specific cleaning unit as the photoreceptor cleaning device, and uses a developer containing the specific toner as the developer stored in the developing device.

The units having such a configuration are provided and thus adhesion of the toner to the surface of the specific photoreceptor (photoreceptor filming) is prevented.

An operation of forming a yellow image by the first unit 10Y will be described below.

First, before the operation, the surface of the photoreceptor 1Y is charged so as to have a potential of from −600 V to −800 V by the charging roller 2Y.

The photoreceptor 1Y has properties that when laser beams 3Y are applied, the specific resistance of a portion irradiated with the laser beams changes. Thus, the laser beams 3Y are output to the charged surface of the photoreceptor 1Y through the exposure device 3 in accordance with image data for yellow transmitted from the controller (not illustrated). A photosensitive layer on the surface of the photoreceptor 1Y is irradiated with the laser beams 3Y, and thereby an electrostatic charge image of a yellow image pattern is formed on the surface of the photoreceptor 1Y.

The electrostatic charge image is an image which is formed on the surface of the photoreceptor 1Y by charging, and is a so-called negative latent image, which is formed when laser beams 3Y are applied to the photosensitive layer so that the specific resistance of the irradiated part is decreased to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at this developing position by the developing device 4Y.

The developing device 4Y stores, for example, a developer including at least a yellow toner and a carrier. The yellow toner is frictionally charged by performing stirring in the developing device 4Y and has charges with the same polarity (negative polarity) as the charge that is generated on the photoreceptor 1Y. Thus, the yellow toner is held on a developer roller. The surface of the photoreceptor 1Y is allowed to pass through the developing device 4Y, and thus the yellow toner electrostatically adheres to the electrostatic latent image on the surface of the photoreceptor 1Y, and thereby the electrostatic latent image is developed by using the yellow toner. The photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, and thereby the toner image on the photoreceptor 1Y is transferred onto the intermediate transfer belt 20. The transfer bias applied at this time has the opposite polarity (+) to the polarity (−) of the toner, and, for example, is controlled so as to be +10 μA in the first unit 10Y by the controller (not illustrated).

The residual substances remaining on the photoreceptor 1Y are removed by the photoreceptor cleaning device 6Y, and a toner of the residual substances is collected.

The primary transfer biases which are applied to the primary transfer rollers 5M, 5C, and 5K of the second unit 10M and the subsequent units are also controlled similarly to a case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The four color toner images which have been multiply-transferred onto the intermediate transfer belt 20 through the first to fourth units reach a secondary transfer part that is made of the intermediate transfer belt 20, the support roller 24 contacting the inner surface of the intermediate transfer belt, and a secondary transfer roller (an example of the secondary transfer unit) 26 disposed on the image holding surface side of the intermediate transfer belt 20.

A recording sheet (an example of the recording medium) P is fed to a gap between the secondary transfer roller 26 and the intermediate transfer belt 20, which contact with each other, through a supply mechanism at a predetermined timing, and a secondary transfer bias is applied to the support roller 24. The transfer bias applied at this time has the same polarity (−) as the polarity (−) of the toner. An electrostatic force toward the recording sheet P from the intermediate transfer belt 20 acts on the toner image, and thereby the toner image of four colors on the intermediate transfer belt 20 is transferred onto the recording sheet P. In this case, the secondary transfer bias is determined depending on the resistance detected by a resistance detector (not illustrated) that detects the resistance at the secondary transfer position, and is voltage-controlled.

Then, the recording sheet P is fed to a nip portion between a pair of fixing rollers (an example of the fixing unit) 28 such that the toner image is fixed to the recording sheet P, and thereby a fixation image is formed.

The fixation temperature by the fixation unit is determined depending on the rotation speed of the photoreceptor (speed of moving of the surface of the photoreceptor) and the type of the toner. Normally, as the rotation speed of the photoreceptor becomes faster, the fixation temperature is preferably increased so as to sufficiently melt the toner. However, the specific toner used for forming a toner image in this exemplary embodiment has high meltability of a toner by containing the release agent therein from the vicinity of the surface layer portion of the toner to the inside of the toner. Accordingly, occurrence of fixation defect is difficult, for example, even when the fixation temperature is lowered. Since decreasing of the fixation temperature may results in reduction of the coarse particulates (UFP), the fixation temperature by the fixation unit is preferably lower than 190° C., more preferably 100° C. or more and less than 190° C., and most preferably in a range of from 160° C. to 180° C. in this exemplary embodiment.

The recording sheet P on which the fixing of the color image is completed is discharged toward a discharge portion and a series of the color image forming operations is ended.

Next, a process cartridge which is detachable from the image forming apparatus will be described.

Figure 2:
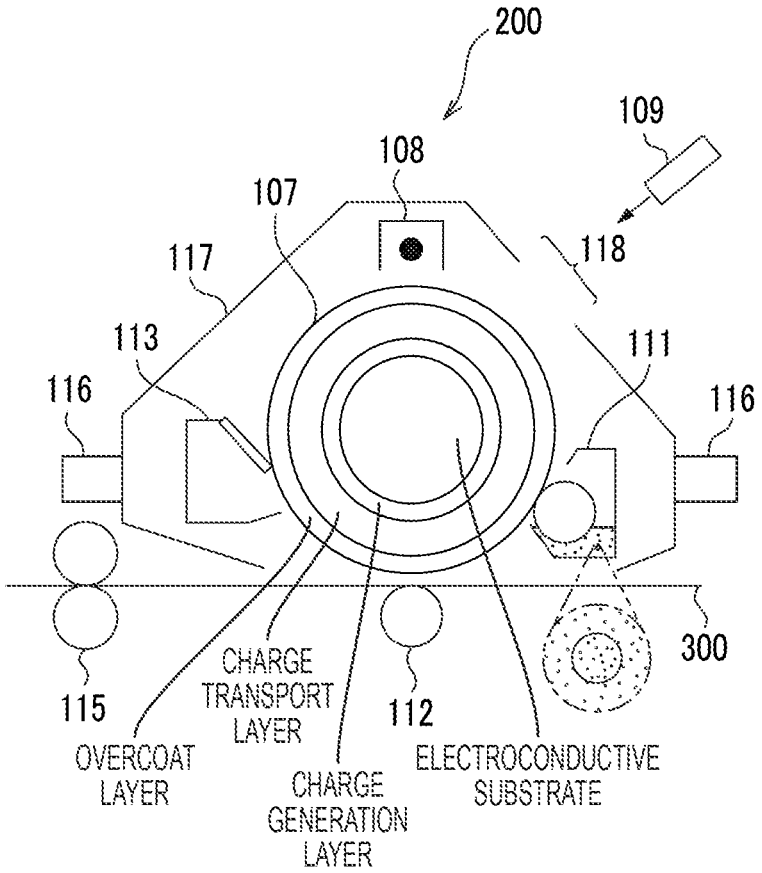
FIG. 2 is a schematic configuration diagram illustrating an example of a process cartridge applicable to this exemplary embodiment.

FIG. 2 is a schematic configuration diagram illustrating the process cartridge.

A process cartridge 200 illustrated in FIG. 2 is formed as a cartridge having a configuration in which a photoreceptor 107, a charging device 108 (an example of the charging unit), a developing device 111 (an example of the developing unit), and a photoreceptor cleaning device 113 (an example of the cleaning unit), which are provided around the photoreceptor 107, are integrally combined and held by using, for example, a housing 117 which includes a mounting rail 116 and an opening 118 for exposure.

In FIG. 2, the reference numeral 109 indicates an exposure device (an example of the electrostatic charge image forming unit), the reference numeral 112 indicates a transfer device (an example of the transfer unit), the reference numeral 115 indicates a fixing device (an example of the fixing unit), and the reference numeral 300 indicates a recording sheet (an example of the recording medium).

Next, components (the specific photoreceptor, the charging unit, the electrostatic latent image forming unit, the developing unit, the transfer unit, the specific cleaning unit, the fixation unit, and the developer) constituting the image forming apparatus according to this exemplary embodiment will be more specifically described.

Descriptions will be made without the reference numerals of the members.

Specific Photoreceptor

The specific photoreceptor according to this exemplary embodiment includes a charge generation layer, a charge transport layer, and an overcoat layer on an electroconductive substrate in this order, and may include other layers in addition to these layers.

In this exemplary embodiment, the charge generation layer and the charge transport layer may be collectively referred to as a "photosensitive layer".

Electroconductive Substrate

Examples of the electroconductive substrate include a metallic plate, a metallic drum, a metallic belt, and the like which contains metal (aluminum, copper, zinc, chromium, nickel, molybdenum, vanadium, indium, gold, platinum, and the like) or alloys of the metal (stainless steel and the like). In addition, examples of the electroconductive substrate include paper, a resin film, a belt, and the like on which a conductive compound (for example, conductive polymer, indium oxide, and the like), metal (for example, aluminum, palladium, gold, and the like), or alloys thereof are coated, evaporated, or laminated. Here, "conductivity" means that volume resistivity is less than $10^{13}$ Ωcm.

When the specific photoreceptor is used in a laser printer, the electroconductive substrate preferably has a rough surface in which a center-line average roughness Ra is in a range of from 0.04 μm to 0.5 μm, in order to prevent an interference fringe occurring when laser beams are applied. When incoherent light is used in a light source, surface roughening for prevention of the occurrence of the interference fringe is not particularly required. However, since occurrence of a defect is prevented due to the uneven surface of the electroconductive substrate, the surface roughening is appropriate for achieving a longer lifetime.

As a method of the surface roughening, for example, a wet honing method, a centerless grinding method, anodization treatment, and the like are included. The wet honing is performed in such a manner that an abradant is suspended in water and is sprayed on a supporting member. The centerless grinding method is performed in such a manner that the electroconductive substrate is pressed on a rotating grindstone and grinding is continuously performed.

As the method of the surface roughening, a method in which the surface of the electroconductive substrate is not roughened, but conductive or semi-conductive powder is dispersed in a resin, a layer is formed on the surface of the electroconductive substrate by using the resin, and roughening is performed by utilizing particles dispersed in the layer is also included.

The surface roughening treatment by anodization is performed in such a manner that anodization is performed by using the metallic (for example, aluminium) electroconductive substrate as an anode in an electrolyte solution and thus an oxide film is formed on the surface of the electroconductive substrate. Examples of the electrolyte solution include a sulfuric acid solution, an oxalic acid solution, and the like. However, a porous anodic oxide film formed by anodization is chemically active as it is. Thus, the porous anodic oxide film is easily contaminated and has a large fluctuation in resistance depending on the environment. Accordingly, sealing treatment is preferably performed on the porous anodic oxide film so as to obtain hydrous oxide which is more stable. The sealing treatment is performed in such a manner that micropores in the oxide film are sealed by volume expansion due to a hydration reaction in compressed steam or boiling water (to which a metal salt of nickel and the like may be added).

The film thickness of the anodic oxide film is preferably in a range of from 0.3 μm to 15 μm, for example. When the film thickness is in the range, it tends to exhibit a barrier property against injection and to prevent an increase of a residual potential caused by repetitive use.

Treatment by using an acidic treatment liquid or boehmite treatment may be performed on the electroconductive substrate.

The treatment by using the acidic treatment liquid is performed as follows, for example. First, an acidic treatment liquid containing phosphoric acid, chromic acid, and hydrofluoric acid is prepared. Regarding mixing ratios of phosphoric acid, chromic acid, and hydrofluoric acid in the acidic treatment liquid, for example, the mixing ratio of the phosphoric acid may be in a range of from 10% by weight to 11% by weight, the mixing ratio of the chromic acid may be in a range of from 3% by weight to 5% by weight, and the mixing ratio of the hydrofluoric acid may be in a range of from 0.5% by weight to 2% by weight. The concentration of the entirety of these acids may preferably be in a range of from 13.5% by weight to 18% by weight. A treatment temperature is, for example, preferably in a range of from 42° C. to 48° C. The film thickness of the film is preferably in a range of from 0.3 μm to 15 μm.

The boehmite treatment is performed, for example, by performing dipping in pure water at a temperature in a range of from 90° C. to 100° C. for a period of time from 5 minutes to 60 minutes, or by contacting heated steam at a temperature in a range of from 90° C. to 120° C., for a period of time from 5 minutes to 60 minutes. The film thickness of the film is preferably in a range of from 0.1 μm to 5 μm. The anodization treatment may be performed by using an electrolyte solution of adipic acid, boric acid, borate, phosphate, phthalate, maleate, benzoate, tartrate, citrate, and the like, which has low film solubility.

Undercoating Layer

An undercoating layer is, for example, a layer which includes inorganic particles and a binder resin.

As the inorganic particles, for example, inorganic particles having powder resistance (volume resistivity) from $10^2$ Ωcm to $10^{11}$ Ωcm are included.

Among the inorganic particles, for example, metal oxide particles such as tin oxide particles, titanium oxide particles, zinc oxide particles, zirconium oxide particles may be used preferably as the inorganic particles having the above resistance value. Particularly, the zinc oxide particles are preferable.

A specific surface area of the inorganic particles by a BET method may preferably be equal to or greater than 10 $m^2/g$, for example.

A volume average particle diameter of the inorganic particle may be, for example, in a range of from 50 nm to 2,000 nm (preferably in a range of from 60 nm to 1,000 nm).

For example, a content of the inorganic particles is preferably in a range of from 10% by weight to 80% by weight relative to the binder resin, and is more preferably in a range of from 40% by weight to 80% by weight.

The inorganic particles may be subjected to surface treatment. The inorganic particle may be used in combination of two or more types of inorganic particles subjected to different types of surface treatment or in combination of two or more types of inorganic particles having different diameters.

Examples of a surface treatment agent include a silane coupling agent, a titanate coupling agent, an aluminum coupling agent, a surfactant, and the like. Particularly, the silane coupling agent is preferable and the silane coupling agent having an amino group is more preferable.

Examples of the silane coupling agent having an amino group include 3-amino propyl triethoxy silane, N-2-(amino ethyl)-3-amino propyl trimethoxy silane, N-2-(amino ethyl)-3-amino propyl methyl dimethoxy silane, N,N-bis (2-hydroxyethyl)-3-amino propyl triethoxy silane. However, it is not limited thereto.

The silane coupling agent may be used by mixing two or more types of silane coupling agents. For example, the silane coupling agent having an amino group and the other silane coupling agent may be used in combination. Examples of the other silane coupling agent include vinyl trimethoxy silane, 3-methacryloxy propyl-tris (2-methoxy ethoxy) silane, 2-(3,4-epoxy cyclohexyl) ethyl trimethoxysilane, 3-glycidoxypropyltrimethoxysilane, vinyl triacetoxy silane, 3-mercaptopropyl trimethoxysilane, 3-aminopropyltriethoxysilane, N-2-(aminoethyl)-3-amino propyl trimethoxy silane, N-2-(aminoethyl)-3-amino propyl methyl dimethoxy silane, N,N-bis (2-hydroxy ethyl)-3-amino propyl triethoxy silane, 3-chloropropyl trimethoxy silane, and the like. However, it is not limited thereto.

As the surface treatment method by using the surface treatment agent, any well-known method may be used and any of a dry method and a wet method may be used.

The amount of the surface treatment agent is, for example, preferably in a range of from 0.5% by weight to 10% by weight relative to the inorganic particles.

The undercoating layer may contain an electron acceptive compound (acceptor compound) along with the inorganic particles from a viewpoint of improving long-term stability of electric characteristics and improving carrier block properties.

As the electron acceptive compound, for example, an electron transport substance is included. Examples of the electron transport substance include a quinone compound such as chloranil and bromanil; a tetracyanoquinodimethane compound; a fluorenone compound such as 2,4,7-trinitrofluorenone, and 2,4,5,7-tetranitro-9-fluorenone; an oxadiazole compound such as 2-(4-biphenyl)-5-(4-t-butylphenyl)-1,3,4-oxadiazole, 2,5-bis (4-naphthyl)-1,3,4-oxadiazole, 2,5-bis (4-diethylaminophenyl)-1,3,4-oxadiazole; a xanthone compound; a thiophene compound; a diphenoquinone compound such as 3,3',5,5' tetra-t-butyl diphenoquinone; and the like.

Particularly, as the electron acceptive compound, a compound having an anthraquinone structure is preferable. Examples of the compound having the anthraquinone structure preferably include a hydroxy anthraquinone compound, an amino anthraquinone compound, an amino hydroxy anthraquinone compound, and the like. Specifically, for example, anthraquinone, alizarin, quinizarine, anthrarufin, purpurin, and the like are preferable.

The electron acceptive compound may be dispersed and contained in the undercoating layer along with the inorganic particles, or may be contained in a state where the electron acceptive compound adheres to a surface of each of the inorganic particles.

As a method of causing the electron acceptive compound to adhere to the surface of the inorganic particle, for example, a dry method and a wet method are included.

The dry method is, for example, a method in which while the inorganic particles are stirred in a mixer providing large shear force and the like, the electron acceptive compound is directly dropped in a mixer or sprayed with the dry air or a nitrogen gas, or the electron acceptive compound dissolved in an organic solvent is dropped in the mixer or sprayed with the dry air or a nitrogen gas, and thereby the electron acceptive compound adheres to the surface of the inorganic particle. When the electron acceptive compound is dropped or sprayed, dropping or spraying may be performed at a temperature of equal to or less than the boiling point of the solvent. After the electron acceptive compound is dropped or sprayed, baking may be performed at 100° C. or higher. The baking temperature and the baking time are not particularly limited as long as electrophotographic characteristics are obtained.

The wet method is, for example, a method in which while dispersing the inorganic particles in a solvent using a stirrer, an ultrasonic wave, a sand mill, an attritor, a ball mill, or the like, the electron acceptive compound is added thereto, the obtained mixture is stirred and dispersed, then the solvent is removed, and thereby the electron acceptive compound adheres to the surface of the inorganic particle. As a solvent removal method, for example, the solvent is removed by performing filtration or distillation. After removal of the solvent, baking may be performed at 100° C. or higher. The baking temperature and the baking time are not particularly limited as long as electrophotographic characteristics are obtained. In the wet method, moisture on the inorganic particles may be removed before the electron acceptive compound is added. As an example of the wet method, a method in which the moisture is removed by stirring and heating the inorganic particles in the solvent, a method in which the moisture is removed by azeotropy with the solvent are included.

Adhering of the electron acceptive compound may be performed before or after the surface treatment is performed on the inorganic particles by using the surface treatment agent. In addition, adhering of the electron acceptive compound and the surface treatment by using the surface treatment agent may be simultaneously performed.

A content of the electron acceptive compound may be, for example, in a range of from 0.01% by weight to 20% by weight relative to the inorganic particle, and is preferably in a range of from 0.01% by weight to 10% by weight.

Examples of the binder resin used in the undercoating layer include a well-known high molecular compound such as an acetal resin (for example, polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, an urea resin, a phenolic resin, a phenol-formaldehyde resin, a melamine resin, an urethane resin, an alkyd resin, and an epoxy resin; a well-known material such as a zirconium chelate compound; a titanium chelate compound; an aluminum chelate compound, a titanium alkoxide compound, an organic titanium compound; and the silane coupling agent.

Examples of the binder resin used in the undercoating layer also include a charge transport resin having a charge transport group, a conductive resin (for example, polyaniline), and the like.

Among these substances, as the binder resin used in the undercoating layer, a resin insoluble in an application solvent of an upper layer is appropriate. Particularly, a resin obtained by a reaction of at least one resin and a curing agent is appropriate. At least the one resin is selected from a group consisting of a thermosetting resin such as an urea resin, a phenolic resin, a phenol-formaldehyde resin, a melamine resin, an urethane resin, an unsaturated polyester resin, an alkyd resin, and an epoxy resin; a polyamide resin, a polyester resin, a polyether resin, a methacrylic resin, an acrylic resin, a polyvinyl alcohol resin, and a polyvinyl acetal resin.

When two or more types of the binder resins are used in combination, the mixing ratio is set arbitrarily.

The undercoating layer may contain various additives for improvement of electric characteristics, improvement of environmental stability, and improvement of image quality.

Examples of the additive include a well-known material such as a polycondensed or azo electron transport pigment, a zirconium chelate compound, a titanium chelate compound, an aluminum chelate compound, a titanium alkoxide compound, an organic titanium compound, and the silane coupling agent. The silane coupling agent is used in the surface treatment for the inorganic particles as described above. However, the silane coupling agent may be added as the additive to the undercoating layer.

Examples of the silane coupling agent used as the additive include vinyl trimethoxy silane, 3-methacryloxy propyl-tris (2-methoxyethoxy) silane, 2-(3,4-epoxycyclohexyl) ethyl trimethoxy silane, 3-glycidoxypropyl trimethoxy silane, vinyl triacetoxy silane, 3-mercaptopropyl trimethoxy silane, 3-aminopropyl triethoxy silane, N-2-(aminoethyl)-3-amino propyl trimethoxy silane, N-2-(aminoethyl)-3-aminopropyl methylmethoxy silane, N,N-bis (2-hydroxyethyl)-3-amino propyl triethoxy silane, 3-chloro-propyl trimethoxy silane, and the like.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, and the like.

Examples of the titanium chelate compound include tetraisopropyl titanate, tetra-n-butyl titanate, butyl titanate dimer, tetra (2-ethylhexyl) titanate, titanium acetylacetonate, poly titanium acetyl acetonate, titanium octylene glycolate, titanium lactate ammonium salt, titanium lactate, titanium lactate ethyl ester, titanium triethanol aminate, polyhydroxy titanium stearate, and the like.

Examples of the aluminum chelate compound include aluminum isopropylate, monobutoxy aluminum diisopropylate, aluminum butyrate, diethyl acetoacetate aluminum diisopropylate, aluminum tris (ethylacetoacetate), and the like.

These additives may be used independently or as a mixture or a polycondensate of plural compounds may be used.

The undercoating layer may preferably have Vickers hardness of 35 or more.

The surface roughness (ten-point average roughness) of the undercoating layer may preferably be adjusted in the range of $(1/(4n))\lambda$ to $(1/2)2$, in which $\lambda$ represents the wavelength of the laser for exposure and n represents a refractive index of the upper layer, in order to prevent a moire image.

Resin particles may be added to the undercoating layer in order to adjust the surface roughness. Examples of the resin particles include silicone resin particles, cross-linked polymethyl methacrylate resin particles, and the like. A surface of the undercoating layer may be polished in order to adjust the surface roughness. As a polishing method, buffing, sandblasting, wet honing, grinding treatment, and the like are included.

Formation of the undercoating layer is not particularly limited, and a known forming method is used. The undercoating layer is formed, for example, in such a manner that a coating liquid for forming an undercoating layer is obtained by adding the above-described component to a solvent, a coated film of the coating liquid is formed and dried, and is heated as necessary.

Examples of a solvent for preparing the coating liquid for forming an undercoating layer include a well-known organic solvent such as an alcohol solvent, an aromatic hydrocarbon solvent, a halogenated hydrocarbon solvent, a ketone solvent, a ketone alcohol solvent, an ether solvent, and an ester solvents.

specific examples of these solvent include a general organic solvent such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

As a method of dispersing the inorganic particles when the coating liquid for forming an undercoating layer is prepared, for example, a well-known method by using a roller mill, a ball mill, a vibrating ball mill, an attritor, a sand mill, a colloid mill, a paint shaker, and the like are included.

As a method of applying the coating liquid for forming an undercoating layer onto the electroconductive substrate, for example, a general method such as a blade coating method, a wire bar coating method, a spray coating method, a dipping coating method, a bead coating method, an air knife coating method, and a curtain coating method is included.

The film thickness of the undercoating layer is, set to be, for example, preferably equal to or greater than 15 μm, and more preferably in a range of from 20 μm to 50 μm.

Intermediate Layer

Although not illustrated, an intermediate layer may be further provided between the undercoating layer and the photosensitive layer (charge generation layer).

The intermediate layer is a layer containing a resin, for example. Examples of the resin used for the intermediate layer includes a high molecular compound such as an acetal resin (for example, polyvinyl butyral), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, and a melamine resin.

The intermediate layer may be a layer containing an organometallic compound. Examples of the organometallic compound used for the intermediate layer includes an organometallic compound and the like which contain a metal atom such as zirconium, titanium, aluminum, manganese, silicon, and the like.

These compound used in the intermediate layer may be used independently or as a mixture or a polycondensate of plural compounds.

Among these compounds, the intermediate layer is preferably a layer containing an organometallic compound which contains a zirconium atom or a silicon atom.

Formation of the intermediate layer is not particularly limited, and a known forming method is used. The intermediate layer is formed, for example, in such a manner that a coating liquid for forming an intermediate layer is obtained by adding the above-described component to a solvent, a coated film of the coating liquid is formed and dried, and is heated as necessary.

As an application method for forming the intermediate layer, a general method such as a dipping coating method, an extrusion coating method, a wire bar coating method, a spray coating method, a blade coating method, a knife coating method, and a curtain coating method is used.

The film thickness of the intermediate layer is, set to be, for example, preferably in a range of from 0.1 μm to 3 μm. The intermediate layer may be used as the undercoating layer.

Charge Generation Layer

The charge generation layer is, for example, a layer containing a charge generation material and the binder resin. The charge generation layer may be a deposition layer of the charge generation material. The deposition layer of the charge generation material is appropriate for a case of using an incoherent light source such as a light emitting diode (LED) and an organic electro-luminescence (EL) image array.

Examples of the charge generation material include an azo pigment such as bisazo and trisazo; a condensed-ring aromatic pigment such as dibromoanthanthrone; a perylene pigment; a pyrrolopyrrole pigment; a phthalocyanine pigment; zinc oxide; trigonal selenium; and the like.

Among these substances, in order to correspond to laser exposure in the near-infrared region, a metal phthalocyanine pigment or metal-free phthalocyanine pigment is preferably used as the charge generation material. Specifically, for example, hydroxy gallium phthalocyanine; chlorogallium phthalocyanine; dichloro-tin phthalocyanine; and titanyl phthalocyanine are more preferable.

In order to correspond to laser exposure in the near-ultraviolet region, a condensed-ring aromatic pigment such as dibromoanthanthrone; a thioindigo pigment; a porphyrazine compound; zinc oxide; trigonal selenium; and a bisazo pigment are preferably used as the charge generation material.

When an incoherent light source such as a LED and an organic EL image array, in which a center wavelength of emitted light is in a range of from 450 nm to 780 nm is used, the charge generation material may be also used. However, when a thin film of 20 μm or less is used as the photosensitive layer, from a viewpoint of the resolution, electric field strength in the photosensitive layer becomes stronger, and charging is lowered due to charge injection from the electroconductive substrate, that is, an image defect which is so-called as a black spot easily occurs. This situation occurs significantly when a charge generation material which is a p-type semiconductor and causes a dark current to easily occur, such as trigonal selenium and a phthalocyanine pigment, is used.

When an n-type semiconductor such as a condensed-ring aromatic pigment, a perylene pigment, and an azo pigment is used as the charge generation material, occurrence of the dark current may be difficult. In addition, the image defect called as the black spot may be prevented even when a thin film of the n-type semiconductor is used. As the n-type charge generation material, for example, compounds (CG-1) to (CG-27) described in paragraphs [0288] to [0291] in JP-A-2012-155282 are included. However, it is not limited thereto.

An n-type is determined by using a time-of-flight method which is generally used, and by using a polarity of a flowing photoelectric current. A material in which electrons more easily flow as a carrier than holes is determined to be the n-type.

The binder resin used in the charge generation layer is selected from insulating resins in a wide range. The binder resin may be selected from an organic photo-conductive polymer such as poly-N-vinylcarbazole, polyvinyl anthracene, polyvinyl pyrene, and polysilane.

Examples of the binder resin include a polyvinyl butyral resin, a polyarylate resin (polycondensate of bisphenol and aromatic bivalent-carboxylic acid, and the like), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, an urethane resin, an epoxy resin, casein, a polyvinyl alcohol resin, and a polyvinyl pyrrolidone resin. Here, the "insulating property" means that the volume resistivity is equal to or greater than $10^{13}$ Ωcm.

These binder resins are used independently or as a mixture of two or more types thereof.

A mixing ratio of the charge generation material and the binder resin is preferably in a range of from 10:1 to 1:10 in a weight ratio.

The charge generation layer may also contain known additives.

A method of forming the charge generation layer is not particularly limited, and a known forming method is used. For example, the charge generation layer is formed in such a manner that a coating liquid for forming a charge generation layer is obtained by adding the above-described component to a solvent, a coated film of the coating liquid is formed and dried, and is heated as necessary. The charge generation layer may be formed by evaporating the charge generation material. Particularly, a method of forming the charge generation layer by deposition is appropriate for a case of using a condensed-ring aromatic pigment or a perylene pigment as the charge generation material.

Examples of a solvent used for preparing the coating liquid for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. Among these solvents, one type is used independently or a mixture of two or more types thereof.

As a method of dispersing particles (for example, charge generation material) in the coating liquid for forming a charge generation layer, for example, a media disperser or a media-less disperser is used. Examples of the media disperser include a ball mill, a vibrating ball mill, an attritor, a sand mill, a horizontal sand mill, and the like. Examples of the media-less disperser include a stirrer, an ultrasonic dispersing machine, a roller mill, a high pressure homogenizer, and the like. Examples of the high pressure homogenizer include a collision type in which a dispersion being in a high pressure state is subjected to liquid-to-liquid collision or liquid-to-wall collision to perform dispersing, a penetration type in which a dispersion being in a high pressure state is penetrated into a fine channel to perform dispersing, and the like.

When dispersing is performed, it is effective that an average particle diameter of the charge generation material in the coating liquid for forming a charge generation layer is equal to or less than 0.5 μm, preferably equal to or less than 0.3 μm, and more preferably equal to or less than 0.15 μm.

As a method of applying the coating liquid for forming a charge generation layer onto the undercoating layer (or onto the intermediate layer), for example, a general method such as a blade coating method, a wire bar coating method, a spray coating method, a dipping coating method, a bead coating method, an air knife coating method, and a curtain coating method is included.

The film thickness of the charge generation layer is set to be, for example, preferably in a range of from 0.1 μm to 5.0 μm, and more preferably in a range of from 0.2 μm to 2.0 μm.

Charge Transport Layer

The charge transport layer is, for example, a layer containing a charge transport material and a binder resin. The charge transport layer may be a layer containing a polymeric charge transport material, for example.

As the charge transport material, an electron transport compound is included. Examples of the electron transport compound include a quinone compound such as p-benzoquinone, chloranil, bromanil, anthraquinone; a tetracyanoquinodimethane compound; a fluorenone compound such as 2,4,7-trinitrofluorenone; a xanthone compound; a benzophenone compound; a cyanovinyl compound; an ethylene compound; and the like. As the charge transport material, a hole transport compound is also included. Examples of the hole transport compound include a triarylamine compound, a benzidine compound, an arylalkane compound, an aryl-substituted ethylene compound, a stilbene compound, an anthracene compound, a hydrazone compound, and the like. Among these charge transport material, one type is used independently or two or more types thereof are used together. However, it is not limited thereto.

As the charge transport material, triarylamine derivative represented by the following formula (a-1), and benzidine derivative represented by the following formula (a-2) are preferable from a viewpoint of charge mobility.

(a-1)

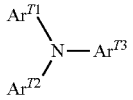

Each of $Ar^{T1}$, $Ar^{T2}$, and $Ar^{T3}$ in the formula (a-1) represents a substituted or unsubstituted aryl group, $—C_6H_4—C(R^{T4})=C(R^{T5})=(R^{T6})$ or $—C_6H_4—CH=CH—CH=C(R^{T7})(R^{T8})$, independently. Each of $R^{T4}$, $R^{T5}$, $R^{T6}$, $R^{T7}$, and $R^{T8}$ represents independently a hydrogen atom, a substituted or unsubstituted alkyl group, or a substituted or unsubstituted aryl group.

Examples of a substituent of each of the groups include a halogen atom, an alkyl group having 1 to 5 carbon atoms, and an alkoxy group having 1 to 5 carbon atoms. Examples of the substituent of each of the groups also include an amino group substituted with an alkyl group having 1 to 3 carbon atoms.

(a-2)

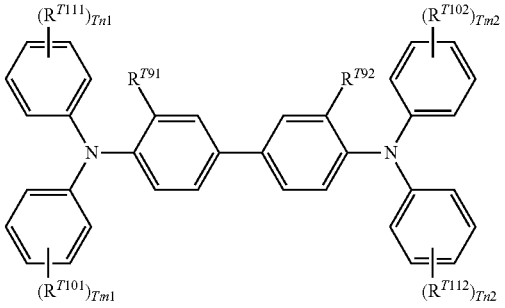

Each of $R^{T91}$ and $R^{T92}$ in the formula (a-2) represents a hydrogen atom, a halogen atom, an alkyl group having 1 to 5 carbon atoms, or an alkoxy group having 1 to 5 carbon atoms, independently. Each of $R^{T101}$, $R^{T102}$, $R^{T111}$, and $R^{T112}$ represents a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{T12})=C(R^{T13})(R^{T14})$ or $—CH=CH—CH=C(R^{T15})(R^{T16})$, independently. Each of $R^{T12}$, $R^{T13}$, $R^{T14}$, $R^{T15}$, and $R^{T16}$ represents a hydrogen atom, a substituted or unsubstituted alkyl group, or a substituted or unsubstituted aryl group, independently. Each of Tm1, Tm2, Tn1, and Tn2 represents an integer of 0 to 2, independently.

Examples of the substituent of each of the groups include halogen atom, an alkyl group having 1 to 5 carbon atoms, and an alkoxy group having 1 to 5 carbon atoms. Examples of the substituent of each of the groups also include a substituted amino group obtained by performing substitution with an alkyl group having 1 to 3 carbon atoms.

Particularly, among triarylamine derivatives represented by the formula (a-1) and benzidine derivatives represented by the formula (a-2), triarylamine derivative having "$—C_6H_4—CH═CH—CH═C(R^{T7})(R^{T8})$" and benzidine derivative having "$—CH═CH—CH═C(R^{T15})(R^{T16})$" are preferable from a viewpoint of charge mobility.

As the polymeric charge transport material, a well-known material such as poly-N-vinyl carbazole and polysilane, which has charge transport properties, is used. Particularly, a polyester-based polymeric charge transport material is preferable. The polymeric charge transport material may be independently used or may be used in combination with a binder resin.

Examples of the binder resin used in the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, a poly-N-vinyl carbazole, polysilane, and the like. Among these substances, the polycarbonate resin or the polyarylate resin are appropriate as the binder resin. These binder resins are used independently or two or more types thereof are used.

A mixing ratio of the charge transport material and the binder resin is preferably in a range of from 10:1 to 1:5 in a weight ratio.

The charge transport layer may also contain known additives.

A method of forming the charge transport layer is not particularly limited, and a known forming method is used. For example, the charge transport layer is formed in such a manner that a coating liquid for forming a charge transport layer is obtained by adding the above-described component to a solvent, a coated film of the coating liquid is formed and dried, and is heated as necessary.

As a solvent used for preparing the coating liquid for forming a charge transport layer, a general organic solvent is included. Examples of the general organic solvent include aromatic hydrocarbons such as benzene, toluene, xylene, and chlorobenzene; ketones such as acetone and 2-butanone; halogenated aliphatic hydrocarbons such as methylene chloride, chloroform, and ethylene chloride; cyclic or linear ethers such as tetrahydrofuran and ethyl ether; and the like. These solvents are independently used or a mixture of two or more types thereof is used.

As a method of applying the coating liquid for forming a charge transport layer onto the charge generation layer, there is a general method such as a blade coating method, a wire bar coating method, a spray coating method, a dipping coating method, a bead coating method, an air knife coating method, and a curtain coating method.

The film thickness of the charge transport layer is, set to be, for example, preferably in a range of from 5 μm to 50 μm, and more preferably in a range of from 10 μm to 30 μm.

Overcoat Layer

The overcoat layer is provided on the charge transport layer. The overcoat layer is provided, for example, so as to prevent a chemical change of the photosensitive layer at a time of charging or to more improve mechanical strength of the photosensitive layer and contributes to a longer lifetime of the photoreceptor.

As the overcoat layer, a layer formed by a cured film (cross-linked film) may preferably be applied. Examples of this layer includes a layer described by the following description 1) or 2).

1) Layer formed by a cured film having a composition which contains a reactive group-containing charge transport material having a reactive group and a charge transport skeleton in the same molecule (that is, layer containing polymer or a cross-linked material of the reactive group-containing charge transport material)

2) layer formed by a cured film having a composition which contains a non-reactive charge transport material and a reactive group-containing non-charge transport material which has a reactive group without a charge transport skeleton (that is, layer containing polymer or a cross-linked material of the non-reactive charge transport material and the reactive group-containing charge non-transport material)

As the reactive group in the reactive group-containing charge transport material, a known reactive group is included. Examples of the known reactive group include a chain polymerizable group, an epoxy group, —OH, —OR [where, R represents an alkyl group], $—NH_2$, —SH, —COOH, $—SiR^{Q1}{}_{3-Qn}(OR^{Q2})_{Qn}$ [wherein, $R^{Q1}$ represents a hydrogen atom, an alkyl group, or a substituted or unsubstituted aryl group; $R^{Q2}$ represents a hydrogen atom, an alkyl group, or a trialkylsilyl group; and $_{Qn}$ represents an integer of 1 to 3], and the like.

As the reactive group in the reactive group-containing charge non-transport material, the above-described known reactive group is also included.

The chain polymerizable group is not particularly limited as long as the chain polymerizable group is a functional group capable of causing radical polymerization. For example, the chain polymerizable group may be a functional group having a group which includes at least carbon double bond. Specifically, examples of the chain polymerizable group include a group which includes at least one selected from a vinyl group, a vinyl ether group, a vinyl thioether group, a styryl group (vinyl phenyl group), an acryloyl group, a methacryloyl group, and derivatives of these groups, and the like. Among these groups, as the chain polymerizable group, a group including at least one selected from a vinyl group, a styryl group (vinyl phenyl group), an acryloyl group, a methacryloyl group, and derivatives of these groups is preferable for its excellent reactivity.

The charge transport skeleton of the reactive group-containing charge transport material is not particularly limited as long as the charge transport skeleton is a skeleton derived from a well-known charge transport material used in the electrophotographic photoreceptor. For example, a skeleton derived from a nitrogen-containing hole transport compound such as a triarylamine compound, a benzidine compound, and a hydrazone compound is included. Among these skeletons, a triarylamine skeleton is preferable.

As the non-reactive charge transport material, well-known compounds including the above-described charge transport skeleton are included. Among these compounds, the triarylamine compound is preferable.

The reactive group-containing charge transport material which contains the reactive group and the charge transport skeleton, the non-reactive charge transport material, and the reactive group-containing charge non-transport material may be selected from known materials.

The overcoat layer may contain known additives in addition to the above-described material.

A method of forming the overcoat layer may be determined in accordance with a material to be used, and a known forming method is used therefor.

For example, the overcoat layer is formed in such a manner that a coating liquid for forming an overcoat layer is obtained by adding the above-described component to a solvent, a coated film of the coating liquid is formed and dried, and is subjected to curing treatment such as heating, as necessary.

Examples of a solvent used for preparing the coating liquid for forming an overcoat layer include an aromatic solvent such as toluene and xylene; a ketone solvent such as methyl ethyl ketone, methyl isobutyl ketone, and cyclohexanone; an ester solvent such as ethyl acetate and butyl acetate; an ether solvent such as tetrahydrofuran and dioxane; a cellosolve solvent such as ethylene glycol monomethyl ether; an alcohol solvent such as isopropyl alcohol and butanol; and the like. These solvents are independently used or a mixture of two or more types thereof is used.

The coating liquid for forming an overcoat layer may be a solvent-free coating liquid.

As a method of applying the coating liquid for forming an overcoat layer onto the charge transport layer, there is a general method such as a dipping coating method, an extrusion coating method, a wire bar coating method, a spray coating method, a blade coating method, a knife coating method, and a curtain coating method.

Siloxane Resin

As the overcoat layer in this exemplary embodiment, a layer containing a siloxane resin is preferable.

As the overcoat layer, a layer which has a structural unit with charge transport capacity and contains a siloxane resin with a cross-linked structure is preferable.

Reactive Organic Silicon Compound

As the siloxane resin, a substance obtained by hydrolysis and dehydration condensation of a reactive organic silicon compound is included.

As the reactive organic silicon compound, a compound represented by the following formula (I) is included.

$$(R^1)_n—Si—(X)_{4-n} \quad (I)$$

In the formula (I), $R^1$ represents an organic group containing carbon atom which is directly bonded to Si. X represents a hydroxyl group or a hydrolyzable group. n represents 0, 1, 2, or 3.

Examples of the organic group represented by $R^1$ include an alkyl group; an aryl group; an organic group including an epoxy group; an organic group including a (meta)acryloyl group; an organic group including a hydroxyl group; a vinyl group or an organic group including the vinyl group; an organic group including a mercapto group; an organic group including an amino group; an organic group including a halogen atom; an alkyl group substituted with a nitro group, a cyano group, or an aryl group. The organic group may include sulfur atom.

As R1, an alkyl group is preferable, an alkyl group having 1 to 10 carbon atoms is more preferable, and an alkyl group having 1 to 4 carbon atoms is further preferable.

Examples of the hydrolyzable group represented by X include an alkoxy group, a halogen atom, and an acyloxy group.

As X, an alkoxy group having 1 to 6 carbon atoms is preferable, and a methoxy group or an ethoxy group is more preferable.

n represents 0, 1, 2, or 3. When n is 2 or 3, plural Rs may be the same or be different. When n is 0, 1, or 2, plural Xs may be the same or be different.

n is preferably 1 or 2.

In this exemplary embodiment, in order to control surface properties of the overcoat layer, two or more types of compounds represented by the formula (I) are preferably used in combination. Two or more types of compounds which have different values of n are more preferably used in combination. Particularly, among compounds represented by the formula (I), a compound in which n is 1 and a compound in which n is 2 are preferably used in combination. The combination use allows improvement of mechanical strength, for example.

Among the compounds represented by the formula (I), a compound represented by the following formula (I-1) is preferable as the compound in which n is 1. A compound represented by the following formula (I-2) is preferable as the compound in which n is 2.

$$R^{11}—Si—(X)_3 \quad (I\text{-}1)$$

$$(R^{11})(R^{12})>Si—(X)_2 \quad (I\text{-}2)$$

In the formulas (I-1) and (I-2), $R^{11}$ and $R^{12}$ each independently is the same as $R^1$ in the formula (I) and the preferable examples of $R^{11}$ and $R^{12}$ is the same as preferable examples of $R^1$. X in the formulas (I-1) and (I-2) each is the same as X in the formula (I) and the preferable examples thereof are the same as the preferable examples of X in the formula (I).

Specific examples of the compound represented by the formula (I-1) include methyl trichloro silane, vinyl trichloro silane, ethyl trichloro silane, allyl trichloro silane, n-propyl trichloro silane, n-butyl trichloro silane, chloromethyl triethoxy silane, methyl trimethoxy silane, mercaptomethyl trimethoxy silane, trimethoxy vinyl silane, ethyl trimethoxy silane, 3,3,4,4,5,5,6,6,6-nonafluorohexyl trichloro silane, phenyl trichloro silane, 3,3,3-trifluoropropyl trimethoxy silane, 3-chloropropyl trimethoxy silane, 3-mercaptopropyl trimethoxy silane, 3-aminopropyl trimethoxy silane, 2-aminoethyl aminomethyl trimethoxy silane, benzyl trichlorosilane, methyl triacetoxy silane, chloromethyl triethoxy silane, ethyl triacetoxy silane, phenyl trimethoxy silane, 3-allyl thiopropyl trimethoxy silane, 3-glycidoxy propyl trimethoxy silane, 3-bromopropyl triethoxy silane, 3-allylamino propyl trimethoxy silane, propyl triethoxy silane, hexyl trimethoxy silane, 3-amino propyl triethoxy silane, 3-methacryloxy propyl trimethoxy silane, pentyl triethoxy silane, octyl triethoxysilane, dodecyl triethoxy silane, and the like.

Among these substances, methyl trimethoxy silane and ethyl trimethoxy silane are preferable.

Specific examples of the compound represented by the formula (I-2) include dimethyl dichloro silane, dimethoxy dimethyl silane, methyl-3,3,3-trifluoropropyl dichloro silane, dimethoxy methyl-3,3,3-trifluoropropyl silane, 3-chloro-propyl dimethoxy methyl silane, chloro methyl diethoxy silane, diethoxy dimethyl silane, dimethoxy-3-mercaptopropyl methyl silane, 3,3,4,4,5,5,6,6,6-nonafluorohexyl methyl dichloro silane, methyl phenyl dichloro silane, diacetoxy methyl vinyl silane, diethoxy methyl vinyl silane, 3-methacryloxy propyl methyl dichloro silane, 3-aminopropyl diethoxy methyl silane, 3-(2-amino-ethyl-aminopropyl) dimethoxy methyl silane, t-butyl phenyl dichloro silane, 3-methacryloxy propyl dimethoxy methyl silane, 3-(3-cyanopropyl thio propyl) dimethoxy methyl silane, 3-(2-acetoxyethyl thiopropyl) dimethoxy methyl silane, dimethoxy methyl-2-piperidino ethyl silane, dibutoxy dimethyl silane, 3-dimethyl aminopropyl diethoxy methyl silane, diethoxymethyl phenyl silane, diethoxy-3-glycidoxypropyl methyl silane, 3-(3-acetoxypropyl thio) propyl dimethoxy methyl silane, dimethoxy methyl-3-piperidino propyl silane, diethoxy methyl octadecyl silane, and the like.

Among these substances, dimethoxy dimethyl silane, dimethoxy diethyl silane are preferable.

Regarding the compound represented by the formula (I), when two or more types of compounds having different values of n are used together, a combination ratio may be appropriately selected in accordance with surface properties and the like of the overcoat layer.

For example, when a compound in which n is 1, and a compound in which n is 2 are used together among the compounds represented by the formula (I), the combination ratio (weight basis) is preferably (compound in which n is 1):(compound in which n is 2)=20:1 to 1:10, and more preferably 10:1 to 1:5.

The overcoat layer containing the siloxane resin is formed as follows, for example.

For example, the overcoat layer containing the siloxane resin is formed in such a manner that a coating liquid containing the compound represented by the formula (I) is prepared, the prepared coating liquid is applied onto the charge transport layer, and drying is performed.

At least a portion of the compound represented by the formula (I) becomes a condensate (oligomer) in the solvent of the coating liquid by hydrolysis and dehydration condensation reaction which occurs after the hydrolysis. The coating liquid containing the condensate is applied onto the charge transport layer and is dried. Thus, the hydrolysis and the dehydration condensation reaction proceed more and thereby a siloxane resin layer having a three-dimensional mesh structure (cross-linked structure) is formed. This siloxane resin layer is used as the overcoat layer.

Particularly, the siloxane resin layer which has elasticity and rigidity and has small surface free energy may be formed by using the coating liquid obtained by using a compound in which n is 1 and a compound in which n is 2 together among the compounds represented by the formula (I).

As the solvent used for preparing a coating liquid containing the compound represented by the formula (I), various solvents used for preparing the above-described coating liquid for forming an overcoat layer are used.

As a method of applying the coating liquid containing the compound represented by the formula (I) onto the charge transport layer, the same method as the method of applying the coating liquid for forming an overcoat layer onto the charge transport layer is applied.

When the siloxane resin layer is formed, a drying temperature of the coating liquid (coated film) is preferably equal to or higher than 80° C.

It is preferable that the dried siloxane resin layer is heated again at a temperature of 30° C. to 100° C. for several hours or more.

When the siloxane resin layer is formed, a catalyst for promoting the dehydration condensation reaction on the reactive organic silicon compound is preferably used in the coating liquid.

As the catalyst, there is a well-known catalyst such as acid, metal oxide, a metal salt, a metal chelate compound, and an alkyl amino silane compound. Among these catalysts, titanium chelate, aluminum chelate, and a tin organic acid salt, as well as phosphoric acid and acetic acid, are preferable. Examples of the tin organic acid salt include stannous octoate, dibutyl tin diacetate, dibutyl tin dilaurate, dibutyl tin mercaptide, dibutyltin thiocarboxylate, and dibutyltin maleate.

Compound Including Reactive Group Reacting with Reactive Organic Silicon Compound and Charge Transport Skeleton (Specific Reactive Group-Containing Charge Transport Material)

The siloxane resin contained in the overcoat layer preferably has charge transport capacity.

The siloxane resin having charge transport capacity is obtained, for example, by causing the above-described reactive organic silicon compound and a condensate thereof to react with a compound (referred to as a specific reactive group-containing charge transport material below) which has a reactive group capable of reacting with the reactive organic silicon compound and the condensate, and a charge transport skeleton. Here, the condensate of the reactive organic silicon compound is obtained by the hydrolysis and the dehydration condensation reaction of the reactive organic silicon compound.

As the specific reactive group-containing charge transport material, a reactive group-containing charge transport material which includes the above-described reactive group and the above-described charge transport skeleton, and the like is included. More specifically, a compound represented by the following formula (II) is included.

$$B—(R^2—ZH)_m \quad (II)$$

In the formula (II), B represents a group including the charge transport skeleton. $R^2$ represents a single-bond or bivalent alkylene group. Z represents an oxygen atom, s sulfur atom, or NH. m is 1, 2, 3, or 4.

The group including the charge transport skeleton, which is represented by B, is a group of m-valence.

The charge transport skeleton included in B is not particularly limited as long as the charge transport skeleton is a skeleton derived from a well-known charge transport material which is used for the electrophotographic photoreceptor. For example, a skeleton derived from a hole transport compound is included. Examples of the hole transport compound include a triarylamine compound, a benzidine compound, an arylalkane compound, an aryl-substituted ethylene compound, a stilbene compound, an anthracene compound, a hydrazone compound, and the like.

Among these skeletons, B preferably includes a triarylamine skeleton from a viewpoint of charge transport capacity.

As the bivalent alkylene group represented by $R^2$, an alkylene group having 1 to 3 carbon atoms is preferable and a methylene group is more preferable from a viewpoint of reaction with an organic silicon compound or a condensate of the organic silicon compound.

ZH is OH, $NH_2$, or SH, which corresponds to a reactive group, and OH is preferable from a viewpoint of reactivity with an organic silicon compound or a condensate of the organic silicon compound.

The overcoat layer which contains siloxane resin having charge transport capacity is formed, for example, as follows.

For example, the overcoat layer containing the siloxane resin is formed in such a manner that a coating liquid which contains the compound represented by the formula (I) and the compound represented by the formula (II) is prepared, the prepared coating liquid is applied onto the charge transport layer, and drying is performed.

In the coating liquid, or in application and drying, the compound represented by the formula (I) and a condensate thereof are subjected to condensation reaction with the compound represented by the formula (II). Thus, a siloxane resin layer having a three-dimensional mesh structure (cross-linked structure) and charge transport capacity is formed. The formed siloxane resin layer is used as the overcoat layer.

A specific photoreceptor having such a siloxane resin layer as the overcoat layer has elasticity and rigidity and has a small increase of a residual potential and small surface free energy. For this reason, torque fluctuation of a cleaning blade is small and the torque of the cleaning blade is stable. Thus, occurrence of passing of residual substances or curling of the blade is difficult.

Specific examples of the compound represented by the formula (II) are shown below, but are not limited thereto.

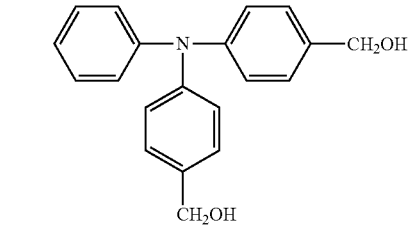

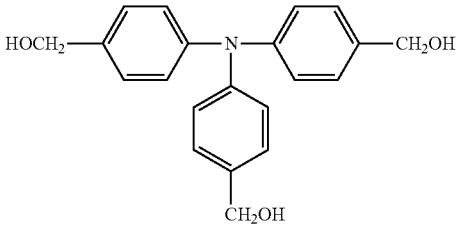

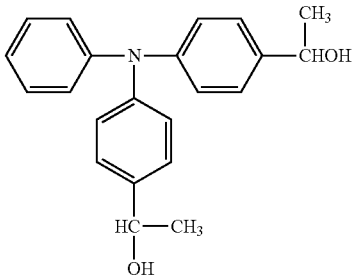

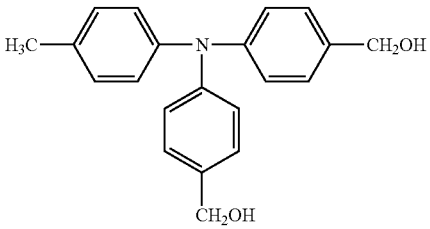

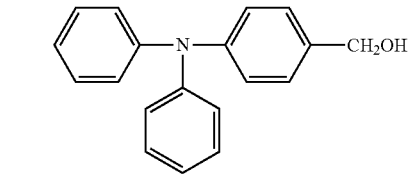

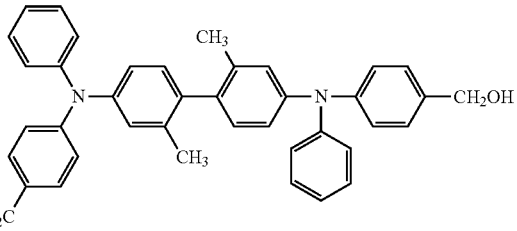

-continued

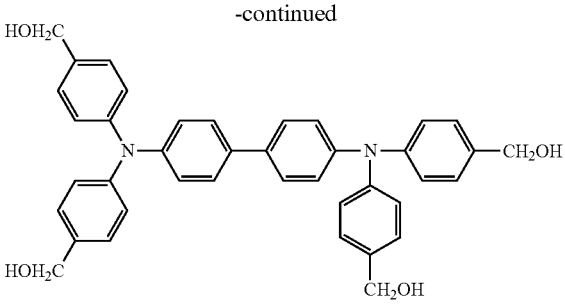

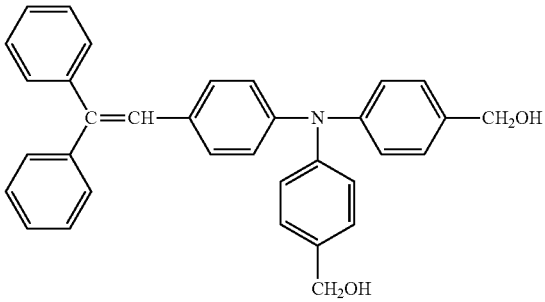

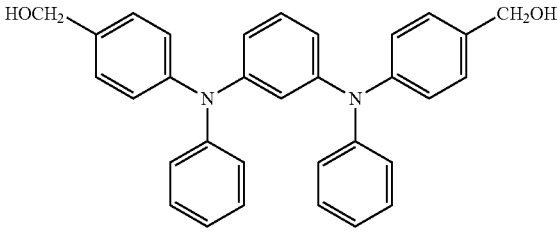

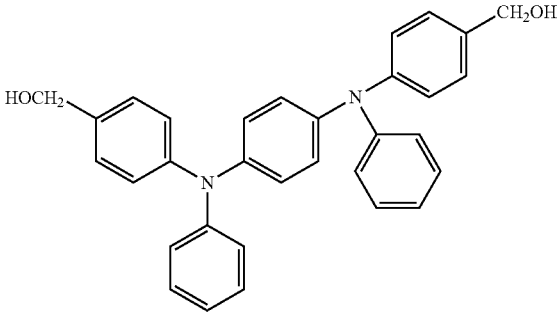

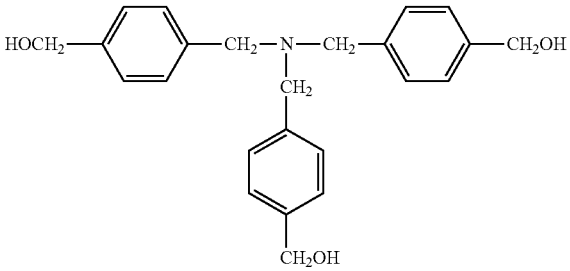

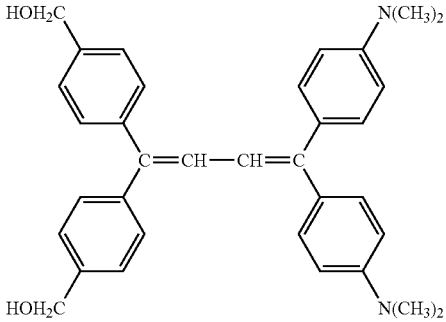

-continued

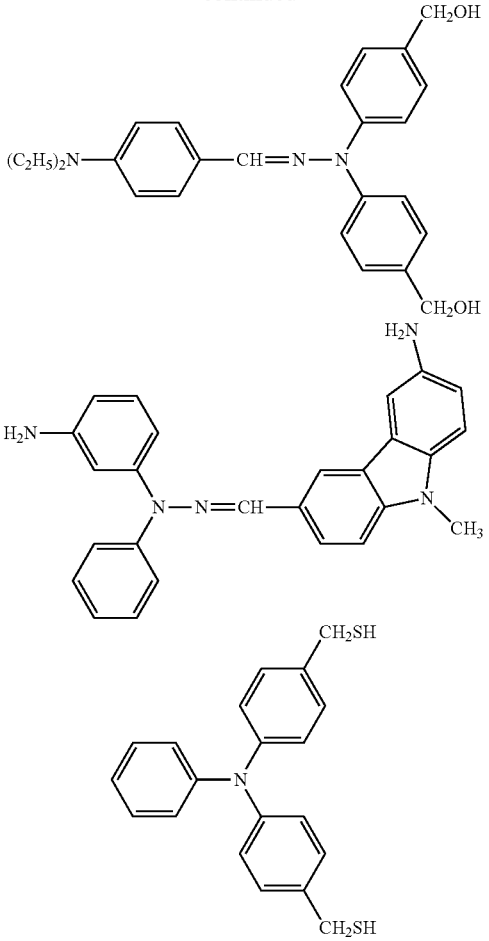

A composition ratio of the total amount (Q1) of the reactive organic silicon compound and the condensate of the reactive organic silicon compound, and an amount (Q2) of the specific reactive group-containing charge transport material is preferably Q1:Q2=100:3 to 50:100 in a weight basis, from a viewpoint of rigidity and elasticity of the overcoat layer. The composition ratio thereof is more preferably Q1:Q2=100:10 to 50:100.

Metal Oxide Particle

The overcoat layer containing a siloxane resin may contain metal oxide particles in order to improve rigidity and elasticity.

A particle diameter of the metal oxide particle is preferably in a range of from 5 nm to 500 nm.

Examples of the metal atom constituting the metal oxide particles include Si, Ti, Al, Cr, Zr, Sn, Fe, Mg, Mn, Ni, Cu, and the like.

The metal oxide particle is generally synthesized by using a liquid-phase method and is obtained as a colloidal particle.

An addition amount (Q3) of the metal oxide particles is preferably in a range of from 1 part by weight to 30 parts by weight relative to the total 100 parts by weight of the total of the amount (Q1) of the reactive organic silicon compound and the condensate of reactive organic silicon compound and the amount (Q2) of the specific reactive group-containing charge transport material, from a viewpoint of hardness and electrophotographic characteristics such as residual potential characteristics, of the overcoat layer.

Antioxidant

The overcoat layer containing the siloxane resin may contain an antioxidant.

As the antioxidant, a well-known antioxidant applied to a photoreceptor is included. That is, hindered phenol, hindered amine, para-phenylenediamine, arylalkane, hydroquinone, spirochroman, spiroindanone, derivatives thereof, an organic sulfur compound, an organic phosphorus compound, and the like are included.

Specific examples of the antioxidant are shown below, but are not limited thereto.

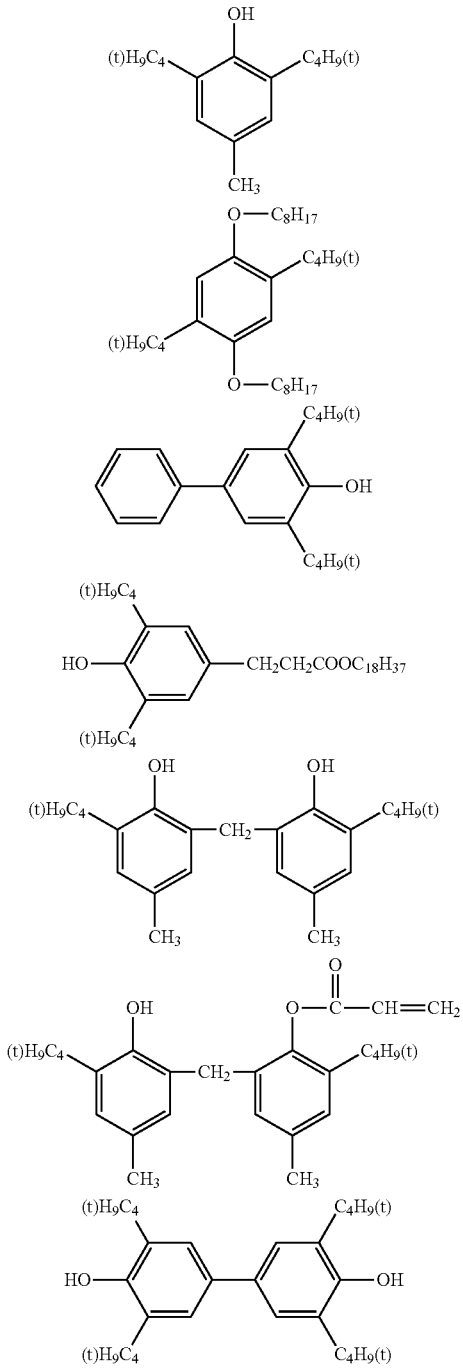

-continued

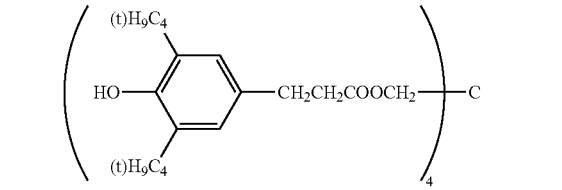

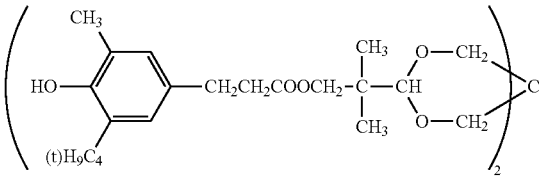

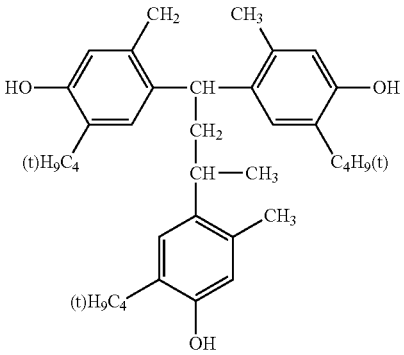

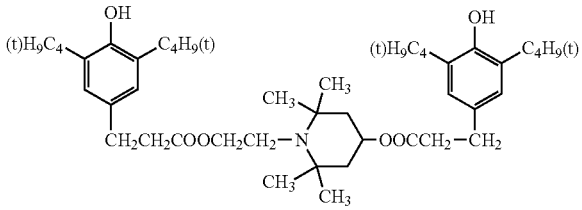

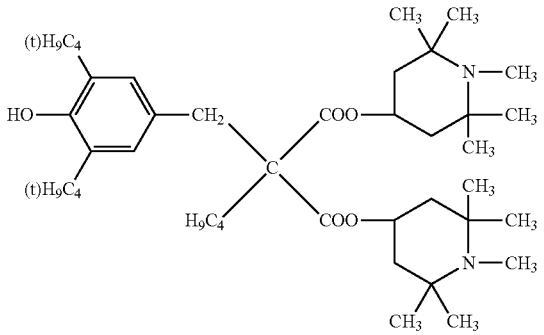

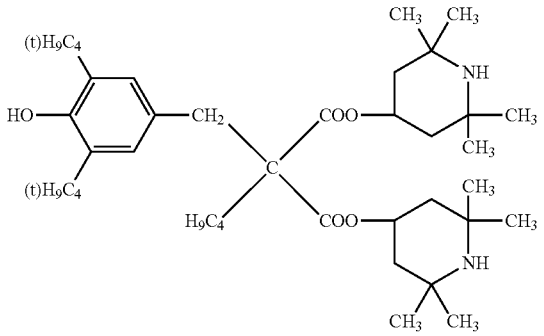

The film thickness of the overcoat layer is, for example, set to be preferably in a range of from 1 μm to 20 μm, to be more preferably in a range of from 1 μm to 10 μm.

Charging Unit

In the image forming apparatus illustrated in FIG. 1, charging rollers 2Y, 2M, 2C, and 2K are used as the charging unit. However, it is not limited to this configuration.

As another example of the charging unit, usable is a contact type charging member which uses a charging brush, a charging film, a charging rubber blade, a charging tube or the like.

A well-known charger such as a non-contact type roller charger, and a scorotron charger or corotron charger using corona discharge may be used.

Electrostatic Latent Image Forming Unit

In the image forming apparatus illustrated in FIG. 1, the exposure device 3 capable of applying the laser beams 3Y, 3M, 3C, and 3K is used as the electrostatic latent image forming unit. However, it is not limited to this configuration.

A light source is used for forming an electrostatic latent image. The light source emits light such as a semiconductive laser beam, LED light, and light for a liquid crystal shutter. At this time, a wavelength of light emitted from the light source is in a spectral sensitivity area of the electrophotographic photoreceptor. Optical system equipment which enables formation of an electrostatic latent image according to an image data on the surface of the specific photoreceptor, and the like, are included.

Most of semiconductive laser beams are near-infrared area rays having an oscillation wavelength in the vicinity of 780 nm. However, it is not limited to this wavelength. As wavelength oscillation laser in a range of from 600 nm to less than 700 nm may be used or laser having an oscillation wavelength from 400 nm to 450 nm may be also used as blue laser. A surface-emitting laser light source which may output multi-beam is also effective for forming a color image.

Developing Unit

As the developing unit, for example, a general developing device which brings a developer into contact or non-contact with the specific photoreceptor so as to perform developing is included.

The developing device is not particularly limited as long as the developing device has the above-described function, and is selected depending on purposes. For example, a well-known developing device which has a function of causing a single-component developer or a two-component developer to adhere to the photoreceptor by using a brush, a roller and the like is included. Among the above-described devices, a developing device using a developing roller which holds a developer on a surface thereof is preferable.

A developer used in the developing unit (developing device) may be a single-component developer formed only of the specific toner which will be described later, and may be a two-component developer formed of the specific toner and a carrier. The developer may be magnetic or nonmagnetic.

Transfer Unit

As the transfer unit, an intermediate transfer type transfer unit using an intermediate transfer member is employed in the image forming apparatus illustrated in FIG. 1. As the transfer unit, the primary transfer rollers 5Y, 5M, 5C, and 5K and the secondary transfer roller 26 are used, but the exemplary embodiment is not limited to this configuration.

As another example of the transfer unit, a transfer unit according to a direct transfer method, and a transfer unit according to a transfer belt method are included. In the direct transfer method, a transfer corotron, a transfer roller, or the like is used. In the transfer belt method, a recording medium is electrostatically adsorbed and fed, so that a toner image on the photoreceptor is transferred thereto.

For example, a well-known transfer charging member such as a contact type transfer charging member using a roller, a belt, a film, a rubber blade, or the like, a scorotron transfer charger and a corotron transfer charger which use corona discharge is used in the transfer unit.

As the intermediate transfer member when the intermediate transfer method is employed, as illustrated in FIG. 1, the intermediate transfer belt 20 is used in the image forming apparatus. However, the exemplary embodiment is not limited thereto.

As the intermediate transfer belt, a belt which has semiconductive properties and contains polyimide, polyamideimide, polycarbonate, polyarylate, polyester, rubber, or the like is used.

A form of the intermediate transfer member is not limited to a belt shape, and a drum-shaped intermediate transfer member may be used.

Specific Cleaning Unit

The specific cleaning unit has a cleaning blade provided such that a tip end of the cleaning blade contacts with the specific photoreceptor and is directed to the direction facing the rotation direction of the specific photoreceptor to remove residual substances on the surface of the specific photoreceptor.

The specific cleaning unit will be described below with reference to FIG. 3.

Figure 3:
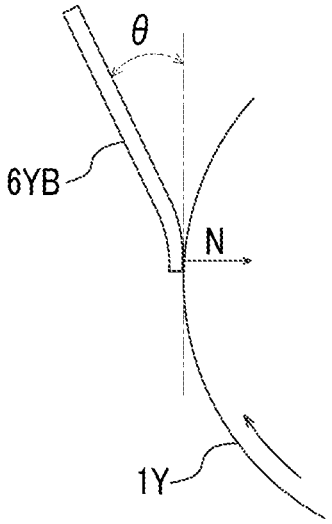
FIG. 3 is a schematic configuration diagram illustrating an installation form of a cleaning blade in this exemplary embodiment.

FIG. 3 is a schematic configuration diagram illustrating an installation form of the cleaning blade when the photoreceptor cleaning device 6Y illustrated in FIG. 1 is the specific cleaning unit.

As illustrated in FIG. 3, a tip end of the cleaning blade 6YB is directed to a direction facing a rotation direction (direction indicated by an arrow) of the photoreceptor 1Y and the tip end of the cleaning blade 6YB contacts with a surface of the photoreceptor 1Y in this state.

An angle θ between the cleaning blade 6YB and the photoreceptor 1Y is preferably set to be in a range of from 5° to 35°, and is more preferably set to be in a range of from 10° to 25°.

Pushing pressure N of the cleaning blade 6YB on the photoreceptor 1Y is preferably set to be in a range of from 0.6 gf/mm$^2$ to 6.0 gf/mm$^2$.

As illustrated in FIG. 3, specifically, the angle θ indicates an angle between a tangential line (dashed line in FIG. 3) and a non-deformation portion of the cleaning blade at a contact point of the photoreceptor 1Y and the tip end of the cleaning blade 6YB.

As illustrated in FIG. 3, the pushing pressure N is pressure (gf/mm$^2$) with which the cleaning blade 6YB is pushed toward the center of the photoreceptor 1Y at a position at which the cleaning blade 6YB contacts with the photoreceptor 1Y.

The cleaning blade in this exemplary embodiment is a plate-shaped material having elasticity.

As a material forming the cleaning blade, an elastic material such as silicone rubber, fluorine rubber, ethylene-propylene-diene rubber, polyurethane rubber is used. Among these substances, polyurethane rubber is preferable since it is excellent in mechanical properties such as wear resistance, chipping resistance, and creep resistance.

A support member (not illustrated in FIG. 3) is bonded to a surface opposite to a surface of the cleaning blade contacting the specific photoreceptor, and the cleaning blade is supported by the support member.

The support member causes the cleaning blade to be pressed on the photoreceptor with the pushing pressure.

As a material of the support member, a metallic material such as aluminum and stainless steel is included.

An adhesion layer, which is formed of an adhesive and the like and which is for bonding the support member and the cleaning blade, may be provided between the support member and the cleaning blade.

The specific cleaning unit may include a known member besides the cleaning blade and the support member for supporting the cleaning blade.

Fixation Unit

In the image forming apparatus illustrated in FIG. 1, a pair of fixation rollers 28 is used as the fixation unit. However, the fixation unit is not limited thereto.

A well-known fixation device is widely used as the fixation unit, but a fixation device including a heating unit is preferable in order to achieve the above-described fixation temperature. Examples of the well-known fixation device include a contact type fixation device such as a pair of heat rollers, a pair of pressing rollers, a pair of heating and pressing rollers; and a non-contact type fixation device such as a flash fixation machine.

The fixation unit do not have to have a form of a pair of rollers. For example, the fixation unit may be a fixation device in which a heating and pressing roller and a pressing belt are combined, or a fixation device in which a pressing roller and a heating and pressing belt are combined.

Developer Containing Specific Toner

A developer stored in the image forming apparatus according to this exemplary embodiment contains the specific toner which will be described below.

First, the specific toner will be described.

The specific toner contains a binder resin, a colorant, and a release agent, and has a sea and island structure in which a sea portion containing the binder resin and an island portion containing the release agent are provided.

In the sea and island structure, a maximum frequent value in distribution of the following eccentricity B of the island portion containing the release agent is in a range of from 0.75 to 0.95, a skewness in the distribution of the following eccentricity B is in a range of from −1.10 to −0.50, and the eccentricity B is represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from the centroid of the toner to the centroid of the island portion containing the release agent in the observation of a cross-section of the toner.

The configuration of the specific toner causes a portion of the release agent which exists close to the surface layer portion of the toner to prevent occurrence of photoreceptor filming as described above. The configuration of the specific toner causes the release agent which is contained from the vicinity of the surface layer portion of the toner to the inside of the toner to exhibit release properties in fixing.

In one toner of the related art, the release agent is positioned so as to be in the vicinity of a surface by using a difference in hydrophilic-hydrophobic properties between a binder resin and a release agent which are dissolved in a solvent. In the other toner of the related art, a release agent is positioned so as to be in the vicinity of a surface by using a kneading and pulverizing method with an uneven distribution-controlling resin, and the uneven distribution-controlling resin has both of a portion with a polarity similar to a polarity of a binder resin and a portion with a polarity similar to a polarity of the release agent. However, the above toners control a position of a release agent in a toner by using a physical property of a material and do not cause distribution of the release agent domain of a toner to have a gradient.

The specific toner will be described below in detail.

The specific toner has the sea and island structure in which the sea portion containing a binder resin and the island portion containing a release agent are present. That is, the specific toner has the sea and island structure in which the release agent exists in a continuous phase of the binder resin so as to have an island shape.

In the toner having the sea and island structure, the maximum frequent value in distribution of eccentricity B of the release agent domain (island portion containing the release agent) is in a range of from 0.75 to 0.95, is preferably in a range of from 0.80 to 0.95, and more preferably in a range of from 0.85 to 0.90.

The maximum frequent value being 0.75 or more causes the release agent domain to be close to the surface layer portion of the toner and thus the occurrence of photoreceptor filming may be prevented. The maximum frequent value being 0.95 or less prevents the release agent domain from exposing to the surface of the toner, and bleeding of the release agent will not occur without applying pressure. Thus the release agent may be used efficiently for the prevention of the occurrence of the photoreceptor filming.

Skewness in the distribution of the eccentricity B of the release agent domain (island portion containing the release agent) is in a range of from −1.10 to −0.50, preferably in a range of from −1.00 to −0.60, and more preferably in a range of from −0.95 to −0.65.

The skewness being in the range of from −1.10 to −0.50 prevents the occurrence of photoreceptor filming and causes the release properties to exhibit in fixing.

Kurtosis in the distribution of the eccentricity B of the release agent domain (island portion containing the release agent) is preferably in a range of from −0.20 to +1.50, more preferably in a range of from −0.15 to +1.40, and further preferably in a range of from −0.10 to +1.30, from a viewpoint of prevention of the occurrence of photoreceptor filming, and the release properties in fixing.

The kurtosis is an index indicating a sharp point of a vertex (that is, the maximum frequent value in the distribution) in the distribution of the eccentricity B. The kurtosis being in the above range indicates a state where an apex portion (maximum frequent value) is not excessively sharp, the apex portion is sharp but simultaneously is appropriately curved in the distribution of the eccentricity B is made. For this reason, the amount of bleeding of the release agent from the toner is smoothly changed depending on pressure and thus, balance of prevention of the occurrence of the photoreceptor filming and appearing of the release properties in fixing becomes better.

A confirming method of the sea and island structure of the toner will be described.

The sea and island structure of the toner is confirmed, for example, by a method of observing a cross-section of the toner (toner particle) using a transmission electron microscope, or a method of dyeing a cross-section of the toner particle with ruthenium tetroxide and observing the dyed cross-section using a scanning electron microscope. The method of observation using a scanning electron microscope is preferable in that the release agent domain in the cross-section of the toner may be observed more clearly. As the scanning electron microscope, a model which has been known well to those skilled in the related art may be used. For example, SU8020 manufactured by Hitachi High-Technologies Corporation, JSM-7500F manufactured by JEOL Ltd., and the like are included.

Specifically, an observing method is performed as follows. First, a toner (toner particle) to be measured is embedded in an epoxy resin, and then the epoxy resin is cured. This cured substance is cut into a thin section with a microtome including a diamond blade to thereby obtain an observation sample in which a cross-section of the toner is exposed. Dyeing with ruthenium tetroxide is performed on the thin observation sample and the cross-section of the toner is observed by using a scanning electron microscope. Using this observing method, a sea and island structure in which a release agent having a brightness difference (contrast) caused by a dyeing degree with respect to a continuous phase of a binder resin exists so as to have an island shape in the cross-section of the toner is observed.

Next, a measuring method of the eccentricity B of the release agent domain will be described.

The eccentricity B of the release agent domain is measured as follows. First, an image is recorded at magnification which allows a cross-section of one toner (toner particle) to come in sight, by using the confirming method of the sea and island structure. Image analysis for the recorded image is performed under a condition of 0.010000 μm/pixel by using image analysis software (WINROOF manufactured by MITANI Corporation). A shape of the cross-section of the toner is extracted by this image analysis by using a brightness difference (contrast) between the epoxy resin used in embedding and the binder resin of the toner. A projected area is obtained based on the extracted shape of the cross-section of the toner. An equivalent circle diameter is obtained from the projected area. The equivalent circle diameter is calculated by an expression of $2\sqrt{(\text{projected area}/\pi)}$. The obtained equivalent circle diameter is set as an equivalent circle diameter D of the toner in observation of the cross-section of the toner.

A centroid position is obtained based on the extracted shape of the cross-section of the toner. Subsequently, a shape of the release agent domain is extracted by using a brightness difference (contrast) between the binder resin and the release agent, and a centroid position of the release agent domain is obtained. Each of the centroid positions is obtained as follows. x coordinates of the centroids are values obtained by dividing summation of $x_i$ coordinate values by n, and y coordinates of the centroids are values obtained by dividing summation of $y_i$ coordinate values by n, when the number of pixels in an area of the extracted toner or the extracted release agent domain is set as n, xy coordinates of each pixel are set as $x_i$ and $y_i$ (i=1, 2, . . . , n). A distance between the centroid position of the cross-section of the toner and the centroid position of the release agent domain is obtained. The obtained distance is set as a distance d from the centroid of the toner to the centroid of the island portion containing the release agent in observation of the cross-section of the toner.

At last, the eccentricity B of the release agent domain is obtained based on each of the equivalent circle diameter D and the distance d by using Expression (1) (eccentricity B=2d/D). Similarly, the above-described operation is performed on each of plural release agent domains in the cross-section of one toner (toner particle) and thereby the eccentricity B of the release agent domain is obtained.

Next, a calculating method of the maximum frequent value in distribution of the eccentricity B of the release agent domain will be described.

First, the eccentricity B of the release agent domain for 200 toners (toner particles) is measured as described above.

Data of the obtained eccentricity B of each of the release agent domains is subjected to statistical analysis processing in a data sections from 0 in increment of 0.01, and thereby the distribution of the eccentricity B is obtained. The maximum frequent value in the obtained distribution, that is, a value of a data section which appears most in the distribution of the eccentricity B of the release agent domain is obtained. The value of this data section is set as the maximum frequent value in the distribution of the eccentricity B of the release agent domain.

Next, a calculating method of the skewness in the distribution of the eccentricity B of the release agent domain will be described.

First, the distribution of the eccentricity B of the release agent domain is obtained as described above. The skewness in the distribution of the eccentricity B is obtained based on the following expression. In the following expression, the skewness is set as Sk, the number of pieces of data of the eccentricity B of the release agent domain is set as n, values of data of the eccentricity B of the respective release agent domains are set as $x_i$(i=1, 2, . . . , n), an average value of all pieces of data of the eccentricity B of the release agent domain is set as x (x with a bar above), and a standard deviation of all pieces of data of the eccentricity B of the release agent domain is set as s.

$$Sk = \frac{n}{(n-1)(n-2)} \sum_{i=1}^{n} \left( \frac{x_i - \bar{x}}{s} \right)^3$$

Next, a calculating method of the kurtosis in the distribution of the eccentricity B of the release agent domain will be described.

First, the distribution of the eccentricity B of the release agent domain is obtained as described above. The kurtosis in the obtained distribution of the eccentricity B is obtained based on the following expression. In the following expression, the kurtosis is set as Ku, the number of pieces of data of the eccentricity B of the release agent domain is set as n, values of data of the eccentricity B of the respective release agent domains are set as $x_i$(i=1, 2, . . . , n), an average value of all pieces of data of the eccentricity B of the release agent domain is set as x (x with a bar above), and a standard deviation of all pieces of data of the eccentricity B of the release agent domain is set as s.

$$Ku = \frac{n(n+1)}{(n-1)(n-2)(n-3)} \sum_{i=1}^{n} \left( \frac{x_i - \bar{x}}{s} \right)^4 - \frac{3(n-1)^2}{(n-2)(n-3)}$$

Regarding a method for satisfying distribution characteristics of the eccentricity B of the release agent domain in a specific toner, it will be described in a method of preparing the specific toner.

Components of the specific toner will be described below.

The specific toner contains a binder resin, a colorant, and a release agent. Specifically, the toner contains toner particles including the binder resin, the colorant, and the release agent. The toner may contain an external additive adhering to a surface of the toner particle.

Binder Resin

Examples of the binder resin include vinyl resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, laurylmethacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used singly or in combination of two or more kinds thereof.

As the binder resin, a polyester resin is appropriate.

As the polyester resin, for example, a well-known polyester resin is included.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these substances, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and more preferably from 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

The polyester resin is obtained by a known preparing method. Specific examples thereof include a method of performing a reaction at a polymerization temperature set to be in a range of from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is performed while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably in a range of from 40% by weight to 95% by weight, more preferably in a range of from 50% by weight to 90% by weight, and further preferably in a range of from 60% by weight to 85% by weight relative to the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorant may be used singly or in combination of two or more types thereof.

If necessary, the colorant may be surface-treated or used in combination with a dispersing agent. Plural types of colorants may be used in combination.

The content of the colorant is, for example, preferably in a range of from 1% by weight to 30% by weight, and more preferably in a range of from 3% by weight to 15% by weight relative to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters; and the like. The release agent is not limited to these examples.

Among these substances, as the release agent, the hydrocarbon wax (waxes having hydrocarbon as a skeleton) is preferable. The hydrocarbon wax is appropriate because the release agent domain is easily formed and rapid bleeding to the surface of the toner (toner particle) easily occurs in fixing.

The content of the release agent is, for example, preferably in a range of from 1% by weight to 20% by weight, and more preferably in a range of from 5% by weight to 15% by weight relative to the entire toner particles.

Other Additives

Examples of other additives include known additives such as a magnetic material, a charge-controlling agent, and inorganic powder. The toner particles contain these additives as internal additives.

Characteristics of Toner Particles

The toner particles may be toner particles having a single-layer structure, or be toner particles having a so-called core/shell structure composed of a core (core particle) and a coating layer (shell layer) coated on the core.

Here, toner particles having a core/shell structure is preferably composed of, for example, a core containing a binder resin, and other additives such as a colorant and a release agent and a coating layer containing a binder resin.

The volume average particle diameter (D50v) of the toner particles is preferably in a range of from 2 μm to 10 μm, and more preferably in a range of from 4 μm to 8 μm.

Various average particle diameters and various particle size distribution indices of the toner particles are measured by using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

Expression: $$SF1=(ML^2/A)\times(m/4)\times 100$$

In the foregoing expression, ML represents an absolute maximum length of a toner, and A represents a projected area of a toner.

Specifically, the shape factor SF1 is numerically converted mainly by analyzing a microscopic image or a scanning electron microscopic (SEM) image by using of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_2$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_2.2SiO_2$, $CaCO_3$, $MgCO_3$, $BaSO_4$, and $MgSO_4$.

Surfaces of the inorganic particles as an external additive are preferably subjected to a hydrophobizing treatment with a hydrophobizing agent. The treatment with a hydrophobizing agent is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin particles) and a cleaning aid (for example, metal salt of higher fatty acid represented by zinc stearate, and fluorine polymer particles).

The amount of the external additive externally added is, for example, preferably in a range of from 0.01% by weight to 5% by weight, and more preferably in a range of from 0.01% by weight to 2.0% by weight relative to the toner particles.

Method of Preparing Specific Toner

Next, a method of preparing the specific toner will be described.

The specific toner is obtained by externally adding an external additive to toner particles after preparing the toner particles.

The toner particles may be prepared using any of a dry preparing method (for example, kneading and pulverizing method) and a wet preparing method (for example, aggregation and coalescence method, suspension and polymerization method, and dissolution and suspension method). The toner particle preparing method is not particularly limited to these preparing methods, and a known preparing method is employed.

Among these methods, the toner particles may preferably be obtained by the aggregation and coalescence method.

For preparing the toner (toner particle) which satisfies the above-described distribution characteristics of the eccentricity B of the release agent domain as described above, the toner particle may preferably be prepared by an aggregation and coalescence method described below.

Specifically, the toner particle is preferably prepared by processes as follows: a process of preparing each dispersion (dispersion preparation process); a process (first aggregated particle forming process); a process (second aggregated particle forming process); and a process (coalescence process). In the first aggregated particle forming process, particles are aggregated in a dispersion obtained by mixing a first resin particle dispersion and a colorant particle dispersion, and thereby first aggregated particles are formed. The first resin particle dispersion is obtained by dispersing first resin particles corresponding to the binder resin, and the colorant particle dispersion is obtained by dispersing particles of the colorant (also referred to as "colorant particles" below). In the second aggregated particle forming process, a dispersion mixture in which second resin particles corresponding to the binder resin and particles of the release agent (also referred to as "release agent particles" below) are dispersed is prepared. After a first aggregated particle dispersion in which the first aggregated particles are dispersed is prepared, the dispersion mixture is sequentially added to the first aggregated particle dispersion while the concentration of the release agent particles in the dispersion mixture gradually increases. Thus, the second resin particles and the release agent particles are aggregated on a surface of the first aggregated particles, and thereby second aggregated particles are formed. In the coalescence process, a second aggregated particle dispersion in which the second aggregated particles are dispersed is heated to coalesce the second aggregated particles, and thereby toner particles are formed.

The method of preparing the toner particle is not limited to the above descriptions. For example, particles are aggregated in a dispersion mixture obtained by mixing the resin particle dispersion and the colorant particle dispersion. Then, a release agent particle dispersion is added to the dispersion mixture in the process of aggregation while increasing an addition speed gradually or while increasing the concentration of the release agent particles increases. Thus, aggregation of particles proceeds more, and thereby aggregated particles are formed. The toner particles may be formed by coalescing the aggregated particles.

The processes will be described below in detail.

Preparation Process of Dispersion

First, respective dispersions are prepared by using an aggregation and coalescence method. Specifically, a first resin particle dispersion in which first resin particles corresponding to the binder resin are dispersed, a colorant particle dispersion in which colorant particles are dispersed, a second resin particle dispersion in which second resin particles corresponding to the binder resin are dispersed, and a release agent particle dispersion in which release agent particles are dispersed are prepared.

In the dispersion preparation process, descriptions will be made, referring the first resin particles and the second resin particles to as "resin particles" collectively.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

First Aggregated Particle Forming Process

Next, the first resin particle dispersion and the colorant particle dispersion are mixed together.

The first resin particles and the colorant particles are heterogeneously aggregated in the dispersion mixture, and thereby first aggregated particles including first resin particles and colorant particles are formed.

Specifically, for example, an aggregating agent is added to the dispersion mixture and a pH of the dispersion mixture is adjusted to be acidic (for example, the pH is from 2 to 5). If necessary, a dispersion stabilizer is added. Then, the dispersion mixture is heated at the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the dispersion mixture, and thereby the first aggregated particles are formed.

In the first aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the first resin particles.

Second Aggregated Particle Forming Process

Next, after the first aggregated particle dispersion in which the first aggregated particles are dispersed is obtained, a dispersion mixture in which the second resin particles and the release agent particles are dispersed is sequentially added to the first aggregated particle dispersion while increasing the concentration of the release agent particles in the dispersion mixture gradually.

The second resin particles may be the same type as or a different type or from the first resin particles.

The second resin particles and the release agent particles are aggregated on surfaces of the first aggregated particles in a dispersion in which the first aggregated particles, the second resin particles, and the release agent particles are dispersed. Specifically, for example, in the first aggregated particle forming process, when a particle diameter of the first aggregated particle reaches a desired particle diameter, a dispersion mixture in which the second resin particles and the release agent particles are dispersed is added to the first aggregated particle dispersion while increasing the concentration of the release agent particles gradually. The dispersion is heated at a temperature which is equal to or less than the glass transition temperature of the second resin particles.

For example, the pH of the dispersion is substantially in a range of from 6.5 to 8.5, and thus the progress of the aggregation is stopped.

Aggregated particles in which the second resin particles and the release agent particles are attached to the surfaces of the first aggregated particles are formed through this process. That is, second aggregated particles in which aggregates of the second resin particles and the release agent particles are attached to the surfaces of the first aggregated particles are formed. At this time, since the dispersion mixture in which the second resin particles and the release agent particles are dispersed is sequentially added to the first aggregated particle dispersion while increasing the concentration of the release agent particles in the dispersion mixture gradually, the concentration (abundance ratio) of the release agent particles becomes gradually larger toward the radially outside direction of the particles, and the aggregates of the second resin particles and the release agent particles are attached to the surface of the first aggregated particle.

As a method of adding the dispersion mixture, a power feeding addition method may preferably be used. The dispersion mixture may be added to the first aggregated particle dispersion, with a gradual increase of the concentration of the release agent particles in the dispersion mixture, by using the power feeding addition method.

The method of adding the dispersion mixture using the power feeding addition method will be described with reference to the drawing.

Figure 4:
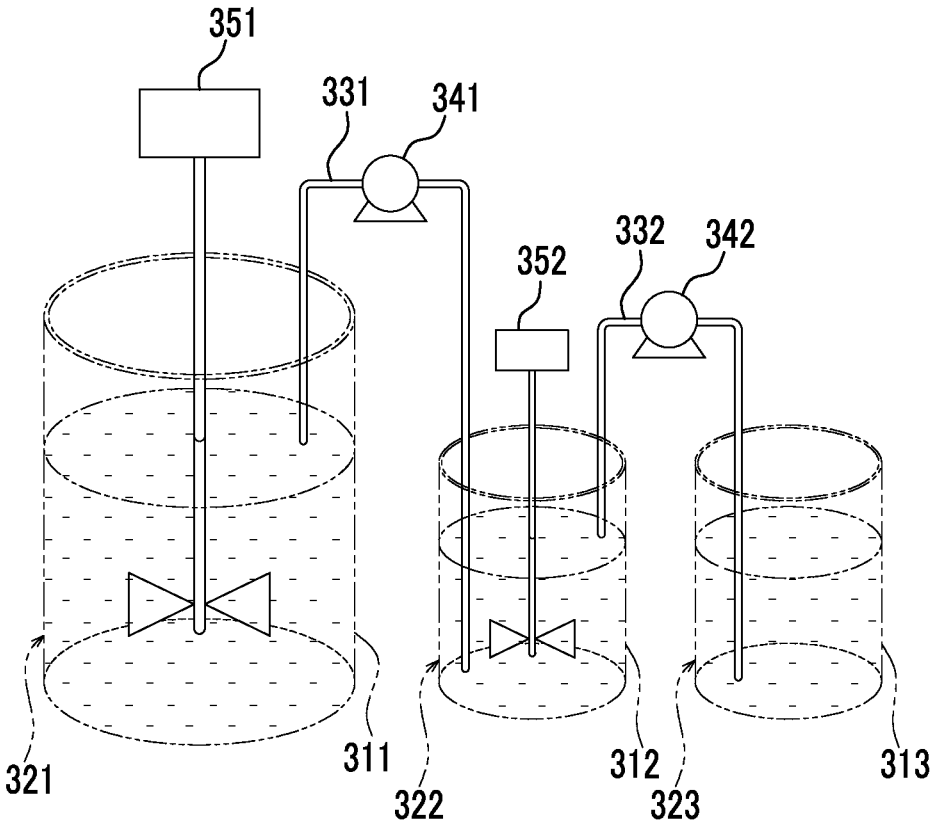
FIG. 4 is a schematic diagram illustrating a power feeding addition method.

FIG. 4 illustrates an apparatus used in the power feeding addition method. In FIG. 4, the reference numeral 311 indicates the first aggregated particle dispersion, the reference numeral 312 indicates the second resin particle dispersion, the reference numeral 313 indicates the release agent particle dispersion.

The apparatus illustrated in FIG. 4 includes a first storage tank 321, a second storage tank 322, and a third storage tank 323. In the first storage tank 321, the first aggregated particle dispersion in which the first aggregated particles are dispersed is stored. In the second storage tank 322, the second resin particle dispersion in which the second resin particles are dispersed is stored. In the third storage tank 323, the release agent particle dispersion in which the release agent particles are dispersed is stored.

The first storage tank 321 and the second storage tank 322 are linked to each other by using a first liquid transport tube 331. A first liquid transport pump 341 is provided in the middle of a path of the first liquid transport tube 331. Driving of the first liquid transport pump 341 causes the dispersion stored in the second storage tank 322 to be transported to the dispersion stored in the first storage tank 321 through the first liquid transport tube 331.

A first stirring apparatus 351 is disposed in the first storage tank 321. When driving of the first stirring apparatus 351 causes the dispersion stored in the second storage tank 322 to be transported to the dispersion stored in the first storage tank 321, the dispersions in the first storage tank 321 are stirred and mixed.

The second storage tank 322 and the third storage tank 323 are linked to each other by using a second liquid transport tube 332. A second liquid transport pump 342 is provided in the middle of a path of the second liquid transport tube 332. Driving of the second liquid transport pump 342 causes the dispersion stored in the third storage tank 323 to be transported to the dispersion stored in the second storage tank 322 through the second liquid transport tube 332.

A second stirring apparatus 352 is disposed in the second storage tank 322. When driving of the second stirring apparatus 352 causes the dispersion stored in the third storage tank 323 to be transported to the dispersion stored in the second storage tank 322, the dispersions in the second storage tank 322 are stirred and mixed.

In the apparatus illustrated in FIG. 4, first, the first aggregated particle forming process is performed and thereby a first aggregated particle dispersion is prepared, in the first storage tank 321. The first aggregated particle dispersion is stored in the first storage tank 321. The first aggregated particle forming process may be performed and thereby the first aggregated particle dispersion may be prepared in another tank, and then, the first aggregated particle dispersion may be stored in the first storage tank 321.

In this state, the first liquid transport pump 341 and the second liquid transport pump 342 are driven. This driving causes the second resin particle dispersion stored in the second storage tank 322 to be transported to the first aggregated particle dispersion stored in the first storage tank 321. Driving of the first stirring apparatus 351 causes the dispersions in the first storage tank 321 to be stirred and mixed.

The release agent particle dispersion stored in the third storage tank 323 is transported to the second resin particle dispersion stored in the second storage tank 322. Driving of the second stirring apparatus 352 causes the dispersions in the second storage tank 322 to be stirred and mixed.

At this time, the release agent particle dispersion is sequentially transported to the second resin particle dispersion stored in the second storage tank 322, and thus the concentration of the release agent particles becomes higher gradually. For this reason, the dispersion mixture in which second resin particles and the release agent particles are dispersed is stored in the second storage tank 322, and this dispersion mixture is transported to the first aggregated particle dispersion stored in the first storage tank 321. The dispersion mixture is continuously transported with an increase of the concentration of the release agent particle dispersion in the dispersion mixture.

In this manner, the dispersion mixture in which the second resin particles and the release agent particles are dispersed may be added to the first aggregated particle dispersion with a gradual increase of the concentration of the release agent particles, by using the power feeding addition method.

In the power feeding addition method, the distribution characteristics of the release agent domain of the toner are adjusted by adjusting liquid transport starting time and a liquid transport speed for each of the dispersions which are respectively stored in the second storage tank 322 and the third storage tank 323. In the power feeding addition method, also by adjusting the liquid transport speed in the process of transporting of the dispersions respectively stored in the second storage tank 322 and the third storage tank 323, the distribution characteristics of the release agent domain of the toner are adjusted.

Specifically, for example, the maximum frequent value in the distribution of the eccentricity B of the release agent domain is adjusted depending on a period of time when transporting of the release agent particle dispersion to the second storage tank 322 from the third storage tank 323 is ended. More specifically, for example, if transporting of the release agent particle dispersion to the second storage tank 322 from the third storage tank 323 is ended before liquid transporting to the first storage tank 321 from the second storage tank 322 is ended, the concentration of the release agent particles in the dispersion mixture of the second storage tank 322 does not increase from that point of time. Thus, the maximum frequent value in the distribution of the eccentricity B of the release agent domain becomes smaller.

For example, the skewness in the distribution of the eccentricity B of the release agent domain is adjusted depending on a period of time when the dispersions are respectively transported from the second storage tank 322 and the third storage tank 323, and a liquid transport speed at which the dispersion is transported to the first storage tank 321 from the second storage tank 322. More specifically, for example, if a liquid transport starting time of the release agent particle dispersion from the third storage tank 323 and a liquid transport starting time of the dispersion from the second storage tank 322 are early, and the liquid transport speed of the dispersion from the second storage tank 322 is lowered, a state where the release agent particles are disposed from a further inner side of the formed aggregated particle to a further outer side thereof is realized. Thus, the skewness in the distribution of the eccentricity B of the release agent domain becomes greater.

For example, the kurtosis in the distribution of the eccentricity B of the release agent domain is adjusted by changing the liquid transport speed of the release agent particle dispersion from the third storage tank 323 in the process of liquid transport. More specifically, for example, if only the liquid transport speed of the release agent particle dispersion from the third storage tank 323 becomes faster in the process of liquid transport, the concentration of the release agent particles in the dispersion of the second storage tank 322 becomes higher from that time. For this reason, there arises a state where many of the release agent particles are disposed in a certain area (certain deep portion) in a radial direction of the aggregated particle in the formed aggregated particle. Thus, the kurtosis in the distribution of the eccentricity B of the release agent domain becomes greater.

The above-described power feeding addition method is not limited to the above method. For example, various methods may be employed. Examples of the various methods include a method in which, a storage tank storing the second resin particle dispersion and a storage tank storing a dispersion mixture in which the second resin particles and the release agent particles are dispersed are separately provided and the respective dispersions are transported to the first storage tank 321 from the respective storage tanks while changing the liquid transport speed, a method in which a storage tank storing the release agent particle dispersion and a storage tank storing a dispersion mixture in which the second resin particles and the release agent particles are dispersed are separately provided, and the respective dispersions are transported to the first storage tank 321 from the respective storage tanks while changing the liquid transport speed, and the like.

As described above, the second aggregated particles in which the second resin particles and the release agent particles are attached to the surfaces of the first aggregated particles and aggregated are obtained.

Coalescence Process

Next, the second aggregated particle dispersion in which the second aggregated particles are dispersed is heated at, for example, a temperature that is equal to or higher than the glass transition temperature of the first and second resin particles (for example, a temperature that is higher than the glass transition temperature of the first and second resin particles by 10° C. to 30° C.) to coalesce the second aggregated particles and form toner particles.

The toner particles are obtained through the above-described processes, but the following method is preferable in order to cause the maximum frequent value in the distribution of the eccentricity B of the release agent domain to be equal to or less than 0.95.

That is, after the aggregated particle dispersion in which the second aggregated particles are dispersed is obtained, toner particles may be prepared through the processes of:

further mixing the second aggregated particle dispersion with a third resin particle dispersion in which third resin particles corresponding to the binder resin are dispersed to perform aggregation so that the third resin particles further adhere to the surfaces of the second aggregated particles, thereby forming third aggregated particles; and coalescing the third aggregated particles by heating the third aggregated particle dispersion in which the third aggregated particles are dispersed, and thereby forming toner particles having a core/shell structure.

A coating layer formed by only the third resin particles is formed by this operation, and the maximum frequent value in the distribution of the eccentricity B of the release agent domain is equal to or less than 0.95.

The third aggregated particle may be the same type as or different type from the first resin particles and the second resin particles.

After the coalescence process is ended, toner particles formed in a solution are subjected to a well-known washing process, a well-known solid-liquid separation process, a well-known drying process, and thereby dried toner particles are obtained.

Regarding the washing process, replacing washing using ion exchanged water may preferably be sufficiently performed for charging property. The solid-liquid separation process is not particularly limited, but suction filtration, pressure filtration, or the like may preferably be performed for productivity. The drying process is not particularly limited, but freeze drying, flash jet drying, fluidized drying, vibrating fluidized drying, and the like may preferably be performed for productivity.

The specific toner is prepared, for example, by adding an external additive to the obtained toner particles in a dried state, and performing mixing. The mixing may be performed, for example, by using a V blender, a HENSCHEL mixer, a Lödige mixer, or the like. Furthermore, if necessary, coarse toner particles may be removed using a vibration sieving machine, a wind classifier, or the like.

Developer

The developer contains at least the above-described specific toner.

The developer may be a single-component developer which contains only the specific toner, or be a two-component developer obtained by mixing the specific toner with a carrier.

The carrier is not particularly limited, and known carriers may be used. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores which are coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluorine resin, polyester, polycarbonate, a phenol resin, and an epoxy resin.

The coating resin and the matrix resin may contain other additives such as conductive particles.

Examples of the conductive particles include particles of metal such as gold, silver, and copper, and particles of carbon black, titanium oxide, zinc oxide, tin oxide, barium sulfate, aluminum borate, potassium titanate, and the like.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the specific toner and the carrier in the two-component developer is preferably from 1:100 to 30:100, and more preferably from 3:100 to 20:100 (toner:carrier).

An example of the image forming apparatus according to this exemplary embodiment is described with reference to the drawings. However, the exemplary embodiment is not limited to the descriptions.

EXAMPLES

This exemplary embodiment will be described more specifically in detail by using examples and comparative examples. However, this exemplary embodiment is not limited these examples. A "part" means a "part by weight" unless otherwise indicated.

Preparation of Resin Particle Dispersion

Preparation of Resin Particle Dispersion (1)

30 parts by mol of terephthalic acid, 70 parts by mol of fumaric acid, 5 parts by mol of an ethylene oxide adduct of bisphenol A, and 95 parts by mol of a propylene oxide adduct of bisphenol A are put into a 5-liter flask provided with a stirrer, a nitrogen inlet tube, a thermometer, and a rectifying column. The temperature of the flask is increased up to 210° C. over one hour, and 1 part of titanium tetraethoxide relative to 100 parts of the materials is put into the flask. The temperature is increased up to 230° C. over 0.5 hours while generated water is distilled away. After a dehydration condensation reaction is continued at that temperature for one hour, the reactant is cooled. In this manner, Polyester resin (1) having a weight-average molecular weight of 18,500, an acid value of 14 mgKOH/g, and a glass transition temperature of 59° C. is synthesized.

40 parts of ethyl acetate and 25 parts of 2-butanol are put into a container provided with a temperature adjusting unit and a nitrogen substituting unit to obtain mixed solvent. Then, 100 parts of Polyester resin (1) are slowly put into the mixed solvent to thereby be dissolved. 10% by weight of an ammonia aqueous solution (having an amount corresponding to three times an acid value of the resin in a molar ratio) is put into the obtained mixture, followed by stirring for 30 minutes.

Then, substitution with dry nitrogen is performed in the container, and the temperature is held at 40° C. 400 parts of ion-exchanged water are dropped into the liquid mixture at a speed of 2 parts/minute while stirring to prepare an emulsion. After dropping is ended, the temperature of the emulsion is returned to the room temperature (20° C. to 25° C.), and bubbling is performed for 48 hours by using dry nitrogen while stirring such that ethyl acetate and 2-butanol are reduced to be equal to or less than 1,000 ppm. Thus, a resin particle dispersion in which resin particles having a volume average particle diameter of 200 nm are dispersed is obtained. Ion-exchanged water is added to the resin particle dispersion so as to adjust a solid content to be 20% by weight, and the obtained dispersion is used as Resin particle dispersion (1).

Preparation of Colorant Particle Dispersion

Preparation of Colorant Particle Dispersion (1)

70 parts of a cyan pigment: C.I. Pigment Blue 15:3 (copper phthalocyanine, product manufactured by DIC Corporation, product name: FASTOGEN BLUE LA5380), 5 parts of anionic surfactant (NEOGEN RK, product manufactured by DKS Co., Ltd.,), and 200 parts of ion-exchanged water are mixed with each other, and are dispersed by using a homogenizer (ULTRA-TURRAX T50, product manufactured by IKA Corporation) for 10 minutes. Ion-exchanged water is added so as to cause a solid content in the dispersion to be 20% by weight, and thereby Colorant particle dispersion (1) in which colorant particles having a volume average particle diameter of 190 nm are dispersed is obtained.

Preparation of Release Agent Particle Dispersion

Preparation of Release Agent Particle Dispersion (1) 100 parts of a paraffin wax (HNP-9, product manufactured by NIPPON SEIRO Co., Ltd.), 1 part of an anionic surfactant (NEOGEN RK, product manufactured by DKS Co., Ltd.), 350 parts of ion-exchanged water are mixed with each other, heated up to 100°, and dispersed by using a homogenizer (ULTRA-TURRAX T50, product manufactured by IKA Corporation). Then, dispersing is performed by using a Manton-Gaulin high-pressure homogenizer (product manufactured by Gaulin Corporation), to thereby obtain Release agent particle dispersion (1) (solid content of 20% by weight) in which release agent particles having a volume average particle diameter of 200 nm are dispersed.

Preparation of Developer (1) Containing Specific Toner

Preparation of Toner Particle (1)

An apparatus (see FIG. 4) having the following configuration is prepared: a round stainless steel flask and a container A are connected to each other by using a tube pump A; driving of the tube pump A causes a liquid stored in the container A is transported to the flask; the container A and a container B are connected to each other by using a tube pump B; driving of the tube pump B causes a liquid stored in the container B to be transported to the container A. The following operations are performed by using this apparatus.

500 parts of Resin particle dispersion (1), 40 parts of Colorant particle dispersion (1), and 2 parts of an anionic surfactant (TaycaPower) are put into a round stainless steel flask, and 0.1 N nitric acid is added to the liquid so as to adjust the pH of the liquid to 3.5. Then, 30 parts of a nitric acid aqueous solution in which a concentration of polyaluminum chloride is 10% by weight are added thereto. Subsequently, the obtained mixture is dispersed at 30° C. by using a homogenizer (ULTRA-TURRAX T50, product manufactured by IKA Corporation), and then, the temperature of the obtained dispersion is increased at a pace of 1° C./30 minutes in an oil bath for heating to thereby increase a particle diameter of aggregated particles.

150 parts of Resin particle dispersion (1) are put into the container A which is a bottle made of a polyester, and 25 parts of Release agent particle dispersion (1) are put into the container B which is a bottle made of a polyester. Then, a liquid transport speed of the tube pump A is set to 0.70 parts/1 minute, and a liquid transport speed of the tube pump B is set to 0.14 parts/1 minute. The tube pumps A and B are driven from a point of time when the temperature of the inside of the round stainless steel flask in the process of forming of the aggregated particle reaches 37.0° C., and thus transporting of the respective dispersions is started. Accordingly, a dispersion mixture in which resin particles and release agent particles are dispersed is transported from the container A to the round stainless steel flask which is in the process of forming of the aggregated particle, with a gradual increase of the concentration of the release agent particles.

The content of the flask is held for 30 minutes from a point of time when the temperature of the inside of the flask is 48° C. after transporting of the dispersions to the flask is ended, and thereby second aggregated particles are formed.

Then, 50 parts of Resin particle dispersion (1) are added slowly and the obtained mixture is held for 1 hour. 0.1 N sodium hydroxide aqueous solution is added thereto to thereby adjust the pH of the mixture to 8.5. Then, heating is performed up to 85° C. with continuous stirring, and the resultant is held for 5 hours. Then, the resultant is cooled to 20° C. at a speed of 20° C./minute, is filtered, is sufficiently washed by using ion-exchanged water, and then is dried. Thus, Toner particles (1) having a volume average particle diameter of 6.0 μm are obtained.

Preparation of Specific Toner (1)

100 parts of Toner particle (1), 0.7 parts of dimethyl silicone oil-treated silica particles (RY200, product manufactured by NIPPON AEROSIL CO., LTD.) are mixed with each other by using a HENSCHEL mixer (peripheral speed of 30 m/s, 3 minutes), and thereby Specific toner (1) is obtained.

Preparation of Developer (1)

Among 100 parts of ferrite particles (average particle diameter of 50 μm), 14 parts of toluene, 3 parts of a styrene/methyl methacrylate copolymer (copolymerization ratio: 15/85), and 0.2 parts of carbon black, the components except for the ferrite particles are dispersed in a sand mill to thereby prepare a dispersion. This dispersion and the ferrite particles are put into a vacuum degassing kneader. Decompression and drying is performed with stirring to thereby obtain a carrier.

8 parts of Specific toner (1) are mixed with 100 parts of the carrier, and thereby Developer (1) is obtained.

Preparation of Developer (C1) Containing Comparative Toner

Toner particles (C1) are obtained in the same manner as in preparing of Toner particles (1) except that the liquid transport speed of the tube pump A is set to 0.55 parts/1 minute, the liquid transport speed of the tube pump B is set to 0.11 parts/1 minute and the tube pumps A and B are driven from a point of time when the temperature of the inside of the flask reaches 30.0° C. Toner particles (C1) have a volume average particle diameter of 5.2 μm.

Similarly to preparation of Specific toner (1), Comparative toner (C1) is prepared by using Toner particles (C1). Similarly to preparation of Developer (1), Developer (C1) is obtained by using Comparative toner (C1).

Various Measurements

Regarding the toner of the developer obtained in each of the examples, the maximum frequent value, the skewness, and the kurtosis in the distribution of the eccentricity B of the release agent domain are measured by using the above-described methods. The results are shown in Table 1.

Preparation of Specific Photoreceptor

Formation of Undercoating Layer 100 parts by weight of Zinc oxide (average particle diameter of 70 nm, specific surface area value of 15 $m^2/g$, product manufactured by Tayca Corporation) and 500 parts by weight of toluene are and mixed with stirring. 1.3 parts by weight of a silane coupling agent (KBM503: product manufactured by Shin-Etsu Chemical Co., Ltd) are added to the obtained mixture, followed by stirring for two hours. Then, toluene is removed by distillation under reduced pressure, baking is performed at 120° C. for three hours, and thereby zinc oxide subjected to surface treatment with the silane-coupling-agent is obtained. 110 parts by weight of the surface-treated zinc oxide and 500 parts by weight of tetrahydrofuran are mixed with stirring. A solution obtained by dissolving 0.6 parts by weight of alizarin in 50 parts by weight of tetrahydrofuran is added thereto, and the obtained mixture is stirred at 50° C. for 5 hours. Then, zinc oxide to which alizarin is attached is filtrated through filtration under reduced pressure, and decompression and drying is further performed at 60° C., and thereby alizarin-attached zinc oxide is obtained.

60 parts by weight of alizarin-attached zinc oxide, 13.5 parts by weight of a curing agent (blocked isocyanates SUMIDUR 3175: product manufactured by Sumitomo Bayer urethane Co., Ltd), and 15 parts by weight of a butyral resin (S-LEC BM-1: product manufactured by SEKISUI CHEMICAL CO., LTD.) are mixed with 85 parts of methyl ethyl ketone, and thereby a liquid is obtained. 38 parts by weight of the obtained liquid is mixed with 25 parts by weight of methyl ethyl ketone. The mixture is dispersed in a sand mill by using glass beads of a diameter of 1 mmϕ for two hours and thereby a dispersion is obtained. 0.005 parts by weight of dioctyl tin dilaurate as a catalyst and 40 parts by weight of silicone resin particles (TOSPEARL 145: product manufactured by Momentive performance materials Inc.) are added to the obtained dispersion, and thereby a coating liquid for forming an undercoating layer is obtained. This coating liquid for forming the undercoating layer is applied onto an aluminium substrate according to a dipping coating method and drying and curing is performed at 170° C. for 40 minutes. Thus, an undercoating layer having a thickness of 20 μm is obtained.

Formation of Charge Generation Layer

A mixture of 15 parts by weight of hydroxy gallium phthalocyanine (CGM-1) as the charge generation material, 10 parts by weight of vinyl chloride-vinyl acetate copolymer resin (VMCH, product manufactured by NUC corporation) as the binder resin, 200 parts by weight of n-butyl acetate is prepared. The hydroxy gallium phthalocyanine has a diffraction peak at the Bragg angle (2θ±0.2°) of at least 7.3°, 16.0°, 24.9°, and 28.0° in an X-ray diffraction spectrum obtained by using a Cukα characteristic X-ray. This mixture is dispersed in the sand mill by using glass beads of a diameter of 1 mmϕ for four hours and thereby a dispersion is obtained. 175 parts by weight of n-butyl acetate and 180 parts by weight of methyl ethyl ketone are added to the obtained dispersion. The obtained mixture is stirred to thereby obtain a coating liquid for forming a charge generation layer. This coating liquid for forming a charge generation layer is applied onto the undercoating layer by using a dipping coating method and drying is performed at the room temperature (25° C.) to thereby obtain a charge generation layer having a thickness of 0.2 μm.

Formation of Charge Transport Layer

Then, 45 parts by weight of N,N'-diphenyl-N,N'-bis(3-methylphenyl)-[1,1']biphenyl-4,4'-diamine (TPD) and 55 parts by weight of a bisphenol Z polycarbonate resin (viscosity-average molecular weight of 50,000) as the binder resin are added and dissolved in 800 parts by weight of a solvent mixture containing tetrahydrofuran (THF) and toluene having a weight ratio of 70/30, and thereby a coating liquid for forming a charge transport layer is obtained. This coating liquid for forming a charge transport layer is applied onto the charge generation layer and dried at 130° C. for 45 minutes, and thereby a charge transport layer having a film thickness of 20 μm is formed.

Formation of Overcoat Layer

Then, 150 parts by weight of methyl trimethoxy silane, 30 parts by weight of dimethyl dimethoxy silane, 100 parts by weight of colloidal silica (methanol solution having a solid content of 30% by weight), 225 parts by weight of 1-butanol, and 106 parts by weight of 2% acetic acid are mixed and stirred at 40° C. for 16 hours. Then, 50 parts by weight of a specific reactive group-containing charge transport material (A) having the following structure, 1 part by weight of an antioxidant (B) having the following structure, and 1 part by weight of aluminum tris acetyl acetate are added to this liquid mixture, and the obtained mixture is stirred at the room temperature for one hour, and thereby a coating liquid for forming an overcoat layer is obtained. This coating liquid for forming an overcoat layer is applied onto the charge transport layer, curing is performed with heating at 110° C. for one hour. Thus, an overcoat layer having a film thickness of 1 μm is formed.

In this manner, a specific photoreceptor is obtained.

(A)

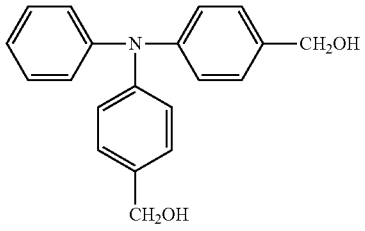

-continued (B)

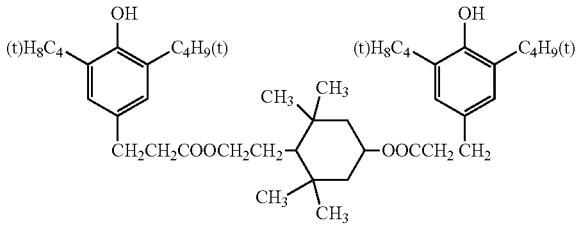

Preparation of Cleaning Blade

A plate-shaped material of 347 mm×10 mm×2 mm (thickness) which is formed of polyurethane and has 75 degree of hardness is used as the cleaning blade.

Evaluation

A modified apparatus in which the above-described specific photoreceptor and the above-described cleaning blade are attached to a D136 Printer manufactured by Fuji Xerox Co., Ltd. and a developer (Developer (1) or (C1)) is stored in the developing device is prepared as the image forming apparatus.

Regarding the cleaning blade, a tip end thereof is directed to the direction facing the rotation direction of the photoreceptor, and contacts with the photoreceptor. At this time, the angle θ is set to 23°, and the pushing pressure N is set to 2.6 gf/mm$^2$.

The rotation speed of the surface of the specific photoreceptor is set to 600 mm/s when an image is formed, and the fixation temperature by the fixation unit is set to 190° C. or 175° C.

Evaluation of Photoreceptor Filming

The image forming apparatus is kept at 40° for one month.

After that, image formation is performed on 100,000 pieces of paper having A4 size with image density of 15% under an environment of a temperature of 28° C. and 85% RH.

After 100,000 images are formed, the surface of the specific photoreceptor is observed with eyes, and it is confirmed whether or not filming occurs. The results are shown in Table 1.

Evaluation of Ultra-fine Particles (UFP)

When 100,000 images are formed in the evaluation of the photoreceptor filming, a particle emission ratio ($PER_{10\ PW}$) of coarse particulates (UFP) emitted from the image forming apparatus is measured based on RAL UZ-171 in an international inspection center of Fuji Xerox Co., Ltd.

Evaluation is performed based on the measured value [unit (the number of particles/10 minutes)] of the particle emission ratio, at three stages of G1 to G3. G1 has the least value and indicates small coarse particulates.

TABLE 1

| | | Distribution of eccentricity B of release agent domain | | | | Evaluation | | |
|---|---|---|---|---|---|---|---|---|
| | Toner No. | Maximum frequent value | Skewness | Kurtosis | Fixation temperature (° C.) | Photo-receptor filming | UFP | Determination |
| Example 1 | (1) | 0.88 | −0.80 | 0.60 | 175 | no occurrence | G1 | G1 |
| Example 2 | (1) | 0.88 | −0.80 | 0.60 | 190 | no occurrence | G2 | G2 |
| Comparative Example 1 | (Cl) | 0.74 | −1.08 | 0.53 | 190 | occurrence | G3 | NG |
| Comparative Example 2 | (Cl) | 0.74 | −1.08 | 0.53 | 175 | — | — | NG (fixation defect) |

It is confirmed from the result that the photoreceptor filming does not occur in the Examples and the coarse particulates (UFP) emitted from the image forming apparatus are smaller in amount than that in Comparative Example 1.

Here, since a content of the release agent in the specific toner is equal to that in the Comparative toner, it is confirmed that the occurrence of the photoreceptor filming is prevented without an increase of the content of the release agent in the toner, in the image forming apparatus of the Examples.

It is confirmed that since the fixation temperature is set to 175° C. in Example 1 and is lower than the fixation temperature of 190° C. in Example 2, the coarse particulates (UFP) in Example 1 are less than those in Example 2.

In the result shown in Table 1, evaluation fields of the photoreceptor filming and the UFP being "–" in Comparative Example 2 mean that both of the evaluations are not performed because fixation defect has occurred due to adhering of the toner to the fixation device (fixation roller) and image forming has been stopped in the process of forming 100,000 images, that is, in forming of a 10,000-th image.

It is considered that this is because the toner is insufficiently melted at the fixation temperature of 175° C., and bleeding of the release agent in the inside of the toner in fixing is difficult because the Comparative toner does not contain the release agent at a position close to the surface layer portion.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor that includes a charge generation layer, a charge transport layer, and an overcoat layer on an electroconductive substrate;

a charging unit that charges a surface of the electrophotographic photoreceptor;

an electrostatic latent image forming unit that forms an electrostatic latent image on the charged surface of the electrophotographic photoreceptor;

a developing unit that stores a developer containing a toner and develops the electrostatic latent image formed on the surface of the electrophotographic photoreceptor by using the developer so as to form a toner image;

a transfer unit that transfers the toner image onto a surface of a recording medium;

a cleaning unit that includes a cleaning blade which contacts with the electrophotographic photoreceptor and removes residual substances on the surface of the electrophotographic photoreceptor; and a fixation unit that fixes the toner image transferred to the recording medium, wherein the toner contains a binder resin, a colorant, and a release agent and has a sea and island structure of a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from the centroid of the toner to the centroid of the island portion containing the release agent in the observation of a cross-section of the toner.

2. The image forming apparatus according to claim 1, wherein the overcoat layer of the electrophotographic photoreceptor contains a siloxane resin.

3. The image forming apparatus according to claim 1, wherein a rotation speed of the electrophotographic photoreceptor is equal to or greater than 300 mm/s.

4. The image forming apparatus according to claim 1, wherein a fixation temperature by the fixation unit is equal to or higher than 100° C. and lower than 190° C.

5. The image forming apparatus according to claim 1, wherein a kurtosis of the distribution of the eccentricity B in the toner is in a range of from −0.20 to +1.50.

6. An image forming method comprising:

charging a surface of an electrophotographic photoreceptor that includes a charge generation layer, a charge transport layer, and an overcoat layer on an electroconductive substrate;

forming an electrostatic latent image on the charged surface of the electrophotographic photoreceptor;

developing the electrostatic latent image formed on the surface of the electrophotographic photoreceptor by using a developer containing a toner so as to form a toner image;

transferring the toner image to a surface of a recording medium;

removing residual substances on the surface of the electrophotographic photoreceptor by using a cleaning blade which contacts with the electrophotographic photoreceptor; and fixing the toner image transferred to the recording medium, wherein the toner contains a binder resin, a colorant, and a release agent, and has a sea and island structure of a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from a centroid of the toner to a centroid of the island portion containing the release agent in the observation of a cross-section of the toner.

7. The image forming method according to claim 6, wherein the overcoat layer of the electrophotographic photoreceptor contains a siloxane resin.

8. The image forming method according to claim 6, wherein a rotation speed of the electrophotographic photoreceptor is equal to or greater than 300 mm/s.

9. The image forming method according to claim 6, wherein a fixation temperature in the fixing is equal to or higher than 100° C. and lower than 190° C.

10. The image forming method according to claim 6, wherein a kurtosis of the distribution of the eccentricity B in the toner is in a range of from −0.20 to +1.50.

* * * * *